US008585841B2

(12) United States Patent
Lubbe et al.

(10) Patent No.: US 8,585,841 B2
(45) Date of Patent: Nov. 19, 2013

(54) SYSTEMS AND METHODS FOR CHEMICAL AND/OR MECHANICAL REMEDIATION OF NITRO COMPOUNDS AND NITRATE ESTERS

(75) Inventors: Carl Hermanus Lubbe, Charleston, WV (US); Delana Harris, Poca, WV (US); José Manuel Botija González, Galdacano (ES); Fernando María Beitia Gómez De Segura, Madrid (ES)

(73) Assignee: MaxamCorp Holding S.L., Madrid (ES)

( * ) Notice: Subject to any disclaimer, the term of this patent is extended or adjusted under 35 U.S.C. 154(b) by 87 days.

(21) Appl. No.: 12/822,730

(22) Filed: Jun. 24, 2010

(65) Prior Publication Data

US 2011/0041718 A1 Feb. 24, 2011

Related U.S. Application Data

(60) Provisional application No. 61/220,020, filed on Jun. 24, 2009.

(30) Foreign Application Priority Data

Oct. 1, 2009 (EP) ..... 09382190

(51) Int. Cl.
*D03D 23/00* (2006.01)
*D03D 43/00* (2006.01)

(52) U.S. Cl.
USPC ..... 149/109.6; 149/108.2; 149/108.4; 149/109.4

(58) Field of Classification Search
USPC ..... 149/109.4, 108.2, 108.4, 109.6
See application file for complete search history.

(56) References Cited

U.S. PATENT DOCUMENTS 3,322,066 A * 5/1967 Griffith et al. ..... 102/318
3,358,600 A 12/1967 Griffith et al.

(Continued)

FOREIGN PATENT DOCUMENTS

JP 2001349700 12/2001
WO WO 02/06855 A2 1/2002

(Continued)

OTHER PUBLICATIONS

Jeffrey L. Davis et al., "Effect of Treatment pH on the End Products of the Alkaline Hydrolysis of TNT and RDX," US Army Corps of Engineers, pp. i-33, Jun. 2007.

(Continued)

*Primary Examiner* — James McDonough
(74) *Attorney, Agent, or Firm* — Craig Metcalf; Kirton McConkie

(57) ABSTRACT

Systems and methods for chemoremediation or mechanical destruction of undetonated explosive materials. An explosive apparatus contains an explosive material in close proximity to a chemical reagent selected for its chemoremediative properties. A barrier is interposed between the explosive material and the chemical reagent to delay the chemoremediation of the explosive material. Alternatively a water expandable material may be incorporated into the explosive material, whereby upon exposure to moisture the water absorbing material will expand sufficiently to fragment the explosive material into initiation insensitive particles. Initiation insensitivity is achieved by incorporation of water, which acts as a desensitizing agent as well as fragmenting the explosive material into particles sufficiently small that they are below the critical diameter for explosive initiation. The present invention also relates to self-degradable, shaped explosive formulations, comprising an explosive material and a water expandable material.

13 Claims, 12 Drawing Sheets

(56) References Cited

U.S. PATENT DOCUMENTS

| | | | | |
|---|---|---|---|---|
| 3,358,601 | A | 12/1967 | Dittmann et al. | |
| 4,000,021 | A | 12/1976 | Voigt, Jr. | |
| 4,057,442 | A | 11/1977 | Shaw et al. | |
| 4,325,759 | A | 4/1982 | Voigt, Jr. et al. | |
| 5,587,553 | A | 12/1996 | Braithwaite et al. | |
| 5,716,557 | A | 2/1998 | Strauss et al. | |
| 6,120,627 | A | 9/2000 | Badger et al. | |
| 6,238,501 | B1 * | 5/2001 | Stec et al. | 149/109.6 |
| 6,388,164 | B1 * | 5/2002 | Desmare et al. | 588/318 |
| 6,651,564 | B1 * | 11/2003 | Tite et al. | 102/312 |
| 6,881,283 | B2 * | 4/2005 | Lee et al. | 149/19.7 |
| 2003/0173008 | A1 | 9/2003 | Lee | |
| 2006/0054257 | A1 * | 3/2006 | Mendenhall et al. | 149/45 |
| 2009/0038496 | A1 | 2/2009 | Maegerlein et al. | |

FOREIGN PATENT DOCUMENTS

| | | | |
|---|---|---|---|
| WO | WO 2009-094714 | A1 | 8/2009 |
| WO | WO 2009/094715 | A1 | 8/2009 |
| WO | WO 2009/094716 | A1 | 8/2009 |

OTHER PUBLICATIONS

Monika Emmrich, "Sequential Desorption of Nitroaromatic Compounds (NAC) from Soils," United States Army European Research Office of the U.S. Army, pp. 1-67, Mar. 2005.

Philip G. Thorne et al., "Continuous Treatment of Low Levels of TNT and RDX Range Soils Using Surface Liming," US Army Corps of Engineers, pp. 1-18, Feb. 2004.

Michael A. Major, "Bioremediation Methods for Treatment of TNT Contaminated Soils," U.S Army Biomedical Research and Development Command, pp. 1-22, Feb. 1994.

Kimitoshi Fukunaga et al., "The Reaction of Vicinal Dinitro Compounds with Tin(II) Chloride," Bulletin of the Chemical Society of Japan, vol. 52, (4), 1107-1111, Apr. 1979.

R.T.M. Fraser, The Alkaline Hydrolysis of Nitrate Esters, Explosives Research and Development Establishment, Report No. 4/R/68, pp. 1-25, May 1968.

* cited by examiner

SYSTEMS AND METHODS FOR CHEMICAL AND/OR MECHANICAL REMEDIATION OF NITRO COMPOUNDS AND NITRATE ESTERS

RELATED APPLICATIONS

This application claims the benefit of U.S. Provisional Application No. 61/220,020 filed Jun. 24, 2009 entitled, SYSTEMS AND METHODS FOR CHEMICAL REMEDIATION OF NITRO COMPOUNDS AND NITRATE ESTERS and European patent application number EP09382190.8, filed Oct. 1, 2009. This application incorporates by reference and claims priority to the provisional and European applications.

FIELD OF THE INVENTION

The present invention relates generally to systems and methods for chemical remediation of explosives. In particular, at least some embodiments of the present invention relate to systems and methods for rendering various types of nitro compounds and nitrate esters safe. The invention also relates to the remediation of explosives which have not detonated; particularly to the degradation of shaped explosive formulations comprising a molecular explosive by means of physical-mechanical decomposition thereof and, if desired, converting the molecular explosive into a safe or environmentally acceptable compound.

BACKGROUND OF THE INVENTION

Nitro-based compounds and nitrate esters are primarily explosive materials used in the manufacture of explosive boosters, seismic boosters, military devices (such as anti-tank mines, anti-personnel mines, bombs, etc.) and other devices designed to be used as part of an ignition system. For example, nitro compounds and nitrate esters are commonly used to initiate a bore hole loaded with secondary explosives. Other applications include using nitro compound and nitrate esters to create seismic waves for exploration of gas and oil. Finally, some applications use nitro compounds and nitrate esters to act as a destructive mechanism, such as a bomb or a mine.

Typical nitro compounds and nitrate esters used in the aforementioned applications include non-limiting examples of pentaerythritol tetranitrate (PETN), 2,4,6-trinitrotoluene (TNT), octogen or cyclotetramethylene tetranitramine (HMX), cyclonite or cyclo-1,3,5-trimethylene-2,4,6-trinitramine (RDX), nitroglycerine, nitroglycol, and tetryl. These materials are commonly used on their own or in combination with each other. For example, a common combination used for seismic exploration is a TNT/PETN mixture called Pentolite. For some applications, these materials or combinations of materials are further combined with other non-explosive materials.

Some applications of Pentolite or other composition types (such as Composition B; a TNT/RDX mixture) are commonly used in boosters for seismic exploration. Explosive formulations intended for seismic exploration (e.g., that conducted for gas and petroleum exploration) have some particular characteristics since, on the one hand, they must maintain their explosive characteristics for at least 6 months from being placed in the subsoil, and, on the other hand, if they do not detonate, their explosive characteristics must disappear at the end of a determined time period so that they cannot be subsequently initiated or detonated due to an external stimulus, thus reducing the risk for the population of an accidental detonation. Seismic exploration is usually done under extremely harsh conditions, occasionally resulting in boosters failing to detonate due to priming system failure. As a result, undetonated explosive charges can remain buried in the soil or in the subsoil but containing potentially explosive compounds that can be accidentally detonated with the resulting risk for people and animals. Very often, the seismic exploration crew will not know whether a seismic booster has failed to detonate because of the type of blasting used. For example, the booster itself is typically buried deep enough and is small enough in its blasting effect that a surface disturbance cannot be used to determine effective detonation. The problem facing the land user is that a "live booster" will remain in the ground for many years. Most of the primary explosives used in "boosters" have a shelf life in excess of twenty years; thus, the latent risk for people is very high. Removal of undetonated boosters is very difficult, if not impossible and potentially a safety hazard.

Similarly, explosives used in military applications, such as bombs, grenades, etc. often do not function as intended and become latent hazards to civilian populations. Additionally, other devices such as mines are intended to have a long sleep time, which becomes a serious problem for the civilian population after intended use of the mine has expired.

Some methods and systems for the degradation or decomposition of undetonated explosive compositions have been developed. Some methods include the use of suitable microorganisms (bioremediation) to render nitro compounds and nitrate esters safe (see, for example, U.S. Pat. No. 7,240,618). The microorganisms are incorporated into the seismic boosters at the time of manufacture under the theory that the microorganisms will be activated after a certain period of time and consume the booster's explosive components (TNT, PETN, RDX, nitrocellulose, halocarbons and hydrocarbons). The method claims to render the seismic booster inert. However, methods of remediation utilizing microorganism show varying levels of effectiveness for the various types of explosive materials. Additionally, use of microorganisms in explosives remediation requires special preparation and culturing of the microorganisms which may be cost prohibitive in some countries.

Other methods for the degradation of undetonated explosive compositions are based on the use of enzymes capable of degrading nitroderivatives or nitroesters. In this sense, the capacity of several redox enzymes, such as ferredoxin NADP oxidoreductase, glutathione reductase, xanthine oxidase and oxyrase, to convert TNT into 4-hydroxylamino-2,6-dinitrotoluene (4-HADNT), as well as the capacity of the PETN reductase to degrade PETN (WO 97/03201) and TNT (WO 99/32636), are known. However, the use of enzymes is very delicate and presents the drawback that the enzymes can be inactivated if the conditions of the environment alter their shaping or secondary structure, they thereby lose their capacity to degrade said compounds.

Methods for the degradation of undetonated explosive compositions based on the use of chemical reagents for the degradation of said explosive compounds (chemical remediation), for example, the use of sodium chlorite to degrade RDX and HMX, have also been described; nevertheless, said methods require the dissolution of reagents and explosives to be degraded and, in addition, when the chemical reagent selected is very reactive with the explosive compounds (e.g., a chlorite), a composition that is unsafe both in its manufacture and in its use could be generated.

Thus, while various devices currently exist for remediating explosive materials, substantial challenges still exist. Accordingly, it would be an improvement in the art to augment or even replace current remediation systems or techniques with other systems and/or techniques. Effectively, although there are several methods and systems for reducing the risk of detonation of undetonated explosive charges, there is still a need to develop alternative methods and systems with respect to those existing which overcome all or some of the previously mentioned drawbacks. Advantageously, said methods and systems must enable, in addition to the decomposition of the undetonated explosive charge, the conversion of the explosive compounds into inert compounds and/or their degradation for the purpose of reducing or eliminating the environmental pollution caused by said compounds.

SUMMARY OF THE INVENTION

The present invention relates generally to systems and methods for chemical and/or mechanical remediation of explosives. In particular, at least some embodiments of the present invention relate to systems and methods for rendering safe various types of nitro compounds and nitrate esters. A safe compound in accordance with the present invention is a compound that is rendered inert (non-explosive) and/or transformed into a compound that is environmentally acceptable. Methods of transformation include, but are not limited to alkaline hydrolysis and/or reduction of nitrate compounds and nitrate esters via appropriate chemical reagents, as well as the incorporation of water expandable materials, optionally combined with said appropriate chemical reagents.

It is thus the broad object of the present invention to protect public health and safety from risks arising from incidents of abandoned, undetonated explosive charges. Accordingly, it is a related object of the present invention to reduce the possibility of detonation of abandoned explosive charges. Furthermore, an object of the present invention is to reduce the likelihood that an abandoned, undetonated explosive charge will contribute to environmental pollution. Thus, it is the specific object of the present invention to provide apparatus, systems, and methods for remediating any installed explosive charge that fails to detonate as intended.

To achieve the foregoing objects, and in accordance with the invention as embodied and broadly described herein, apparatus, systems, mixtures, methods and explosive formulations are provided that chemically or mechanically remediate undetonated explosives utilizing selected chemical reagents and/or water expandable materials.

In a particular aspect, an apparatus incorporating teachings of the present invention includes a quantity of explosive material and chemical reagents disposed in sufficient proximity to one another so that the chemical reagent can initiate chemoremediation (chemical remediation) of the explosive material. In some embodiments, the chemical reagents and the explosive material are disposed in direct contact with one another. In other embodiments, a barrier material is interposedly disposed between the explosive material and the chemical reagents so as to delay the chemoremediation of the explosive materials. The barrier material of the present invention may include any material configured to permit selective interaction between a chemical reagent and the explosive materials of an explosive apparatus. Some embodiments of the present invention utilize a barrier comprising a biodegradable material, such as a biodegradable paper or polymer material. Other embodiments of the present invention utilize a puncturable barrier comprised of a paper material, a metallic material, and/or a polymeric material. Chemical reagents of the present invention are generally selected to remediate explosive materials by at least one chemical mechanism including alkaline hydrolysis of nitro compounds and nitrate esters, and reduction of nitrate esters. The method for manufacturing said apparatus incorporating teachings of the present invention constitute a further aspect of the present invention.

In another particular aspect, an apparatus incorporating teachings of the present invention includes the incorporation of water expandable materials into an explosive material, whereby expansion of the water expandable material fragments the explosive material below the critical diameter for detonation sensitivity (mechanical remediation). In some embodiments, a chemical reagent is combined with a water expandable material to both fragment and render inert an explosive composition. In some embodiments, the water expandable material is incorporated encapsulated in a capsule. The method for manufacturing said apparatus incorporating teachings of the present invention constitute a further aspect of the present invention.

In another particular aspect, the invention relates to a self-degradable, shaped explosive formulation, substantially free of water-soluble oxidizing salts, comprising at least one explosive material, and between 0.2% and 1% by weight with respect to the total weight of the explosive formulation of a water expandable material. In a particular embodiment, the explosive material is a molecular explosive. Also, in another particular embodiment, the water expandable material is a water-swellable polymer. A self-degradable explosive device containing said self-degradable explosive formulation, substantially free of water-soluble salts, constitutes a further aspect of the present invention.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

Figure 1:
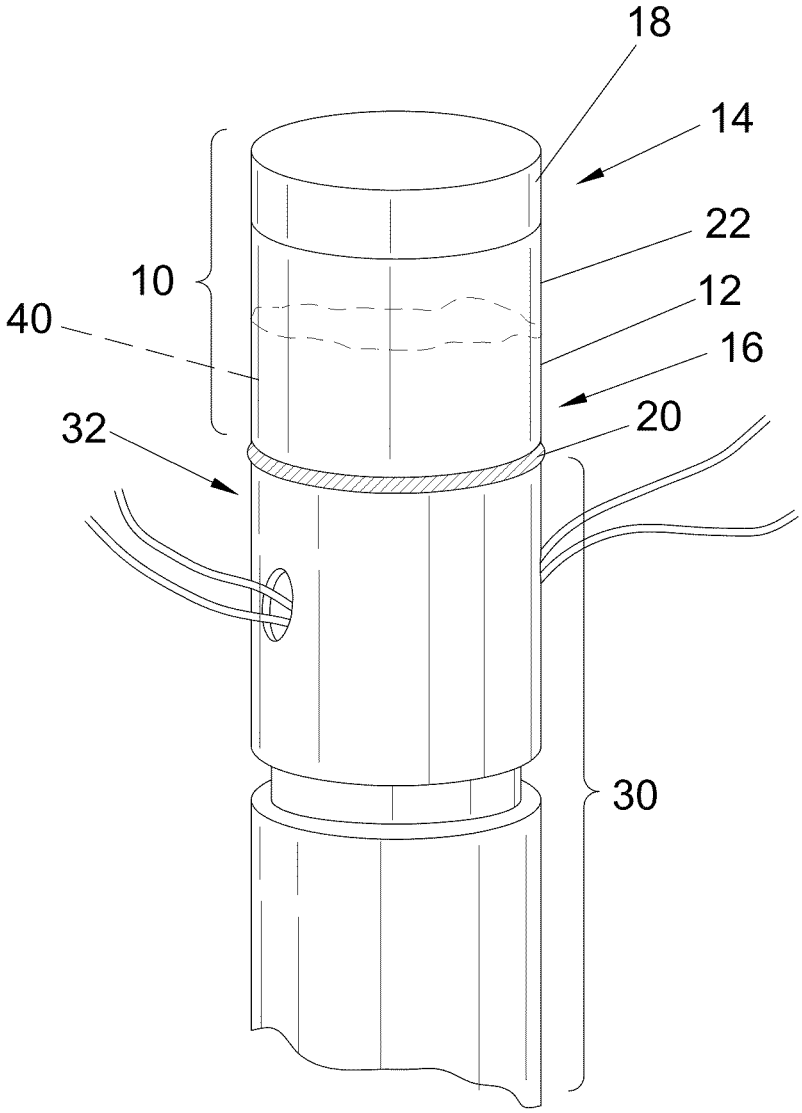
FIG. 1 is a perspective view of an explosive apparatus and chemoremediation apparatus in accordance with a representative embodiment of the present invention.

The present invention relates generally to systems and methods for chemical and/or mechanical remediation of explosives. In particular, at least some embodiments of the present invention relate to systems and methods for rendering various types of nitro compounds and nitrate esters safe. A safe compound in accordance with the present invention is a compound that is rendered inert (non-explosive) and/or transformed into a compound that is environmentally acceptable. Methods of transformation include, but are not limited to alkaline hydrolysis and/or reduction of nitrate compounds and nitrate esters via appropriate chemical reagents (chemoremediation). Other methods of remediation in accordance with the present invention include the incorporation of water expandable materials into an explosive material, whereby expansion of the water expandable material fragments the explosive material below the critical diameter for detonation sensitivity (mechanical remediation). In some embodiments, a chemical reagent is combined with a water expandable material to both fragment and render inert an explosive composition.

According to the teachings of the present invention, an explosive charge to be installed, for example by being buried in the ground, is so housed in a casing with an appropriate chemical reagent. If the explosive charge fails to detonate, the explosive charge can then reliably be left undisturbed, and the chemical reagent will hydrolyze or reduce the explosive material involved. Preferably, the explosive will be thereby both disabled from detonation and rendered environmentally safe. Alternatively, the expansion of the water expandable materials eventually incorporated into an explosive material fragments the explosive material below the critical diameter for detonation sensitivity thus rendering said explosive material insensitive to initiation.

Further, the incorporation of a determined quantity of a water expandable material (e.g., a water-swellable polymer) in an explosive material (e.g., a molecular explosive) renders a self-degradable, shaped explosive formulation, substantially free of water-soluble oxidizing salts; said formulation, if desired, can be used with the apparatus, devices, systems and methods designed and developed following the teachings of the present invention.

The terms "remediate" and "remediation" are used in the specification to refer generally to the conversion or transformation of an explosive material which is detonatable by shock or heat into a different chemical material which is less explosive or non-explosive. The terms "chemoremediate" and "chemoremediation" are used to refer to remediation effected by the action of chemical reagents. The term "mechanical remediation" is used to refer to remediation effected by the action of a water expandable material and it is based on the physical-mechanical breakdown or rupture of the explosive material. The present invention is thus one intended to the chemical and/or mechanical remediation of explosive materials.

The present invention has demonstrated an immediate utility relative to highly explosive materials, such as TNT, PETN, RDX, and HMX. As previously discussed, these explosive materials are commonly utilized in seismic charges.

The term "remediable explosive" is used in the specification to refer to any explosive material which can be converted into a less explosive or non-explosive material. In a particular embodiment, the remediable explosive is a "chemoremediable explosive", i.e., an explosive material which can be converted into a less explosive or non-explosive material by the action of chemical reagents, whether or not such chemical reagents are explicitly disclosed herein. The highly explosive materials listed above are thus chemoremediable explosives, since it has been demonstrated that at least the examples of chemical reagents disclosed herein are capable of converting those highly explosive materials into less explosive or non-explosive materials. In another particular embodiment, the remediable explosive is a "mechanically remediable explosive", i.e., an explosive material which can be converted into a less explosive or non-explosive material by the action of a water expandable material, whether or not such water expandable material is explicitly disclosed herein. The highly explosive materials listed above are also mechanically remediable explosives, since it has been demonstrated that at least the examples of water expandable materials disclosed herein are capable of converting those highly explosive materials into less explosive or non-explosive materials.

Currently, on the basis exclusively of the examples of chemical reagents and water expandable materials disclosed herein, known chemoremediable explosives and mechanically remediable explosives include at least explosives which are classified as organic nitroaromatics, organic nitramines, organic nitric esters, halocarbons or hydrocarbons. Examples of organic nitroaromatics include trinitrotoluene (TNT), hexanitrostilbene (HNS), hexanitroaxobenzene (NAB), diaminotrinitrobenzene, triaminotrinitrobenzene, etc. Examples of organic nitramines include cyclonite or cyclo-1,3,5-trimethylene-2,4,6-trinitramine (RDX), octogen or cyclotetramethylene tetra-nitramine (HMX), nitroguanidine, 2,4,6-trinitrophenylmethylnitramine (tetryl), hexanitrohexaazaisowurtzitane (CL-20), etc. Examples of organic nitric esters include pentaerythritol tetranitrate (PETN), nitroglycerine, nitrocellulose, ethylene glycol dinitrate (EGDN), etc.

Thus, in a particular embodiment, the explosive material is a chemoremediable explosive and/or a mechanically remediable explosive selected from the group of explosive materials which are classified as organic nitroaromatics, organic nitramines, organic nitric esters, halocarbons, hydrocarbons and combinations thereof. In a further particular embodiment, the explosive material is selected from the group of explosives materials consisting of TNT, HNS, NAB, diaminotrinitrobenzene, triaminotrinitro-benzene, RDX, HMX, nitroguanidine, tetryl, CL-20, PETN, nitroglycerine, nitro-cellulose, EGDN, an halocarbon, an hydrocarbon, and mixtures thereof. Illustrative, non-limiting examples of said mixtures include Pentolite (TNT/PETN), Composition B (TNT/RDX), and the like.

In some embodiments of the present invention, highly explosive materials, such as Pentolite, TNT, PETN, RDX and HMX are rendered inert through the action of chemical reagents into non-explosive materials. Virtually any type of chemical reagent capable of rendering explosive materials inert is considered to be within the scope of the present invention. The ability of a chemical reagent to render an explosive material inert can be assessed by conventional methods, such as, those disclosed, e.g., in the accompanying Examples (e.g., Examples 1-6). Briefly, in order to assess if a chemical reagent is suitable for chemoremediating an explosive material, a sample of said explosive material (e.g., Pentolite, PETN, TNT, RDX, HMX, etc.) is contacted with said chemical reagent to be tested and the sample is monitored until the reaction is deemed complete; following completion, sample residues are dried and tested on a standard BAM impact hammer. If said sample residue is no longer impact sensitive, then the chemical reagent may be deemed as a chemoremediating reagent. The presence of the explosive material (e.g., PETN, TNT, RDX or HMX) after chemical remediation can be tested by well known methods, e.g., by high performance liquid chromatography (HPLC), which measures the concentration of a known explosive material, or by testing the impact sensitivity by a Fallhammer apparatus (Example 13).

Chemical reagents capable of converting a explosive material in a non-explosive (inert) material include, but are not limited to suitable bases and/or nitrate compounds reducing agents or nitrate esters reducing agents. Illustrative, non-limiting examples of chemical reagents that have been demonstrated to exhibit that capacity include the group consisting of calcium carbonate, sodium hydroxide, potassium hydroxide, calcium hydroxide, lithium hydroxide, magnesium hydroxide, beryllium hydroxide, cesium hydroxide, barium hydroxide, francium hydroxide, rubidium hydroxide, strontium hydroxide, radium hydroxide, ammonium hydroxide, ferrous chloride, ferrous sulfate, stannous chloride, stannous fluoride, and chemical equivalents thereof. It is within the scope of the present invention to use any combination of these particular chemical reagents that are determined to be capable of chemoremediating explosive materials.

Additional chemical reagents capable of converting a explosive material in a non-explosive material include those reagents mentioned later in connection with the self-degradable formulation of the invention, for example, reducing agents of the nitro, nitrate or nitramino groups. By using said reducing agents, the nitro, nitrate or nitramino groups present in the explosive materials are converted into other functional groups which do not have explosive characteristics.

The present invention thus utilizes any of numerous different selections of chemical reagents capable of rendering inert explosive materials in any of various relative quantities. Each of these various selections of chemical reagents will for convenience hereafter be referred to as a "chemical reagent consortium." In such a chemical reagent consortium, one type of chemical reagent can advantageously reduce the explosive material to a particular intermediate chemical, such as azoaromatics, while that type or another type of chemical reagent may then further reduce the azoaromatics or other intermediate chemicals to carbon chains, $CH_4$, $NH_3$, and $N_2$. In some embodiments, such a chemical reagent consortium utilizes all or some of several of the chemical reagents classed generally as alkaline hydroxide reagents and chloride hydrate reagents. In other embodiments, the nitro group present in some explosive materials (e.g., organic nitroaromatics) is converted into a nitroso group which can in turn be reduced to an amino group, or, alternatively, it can undergo dimerization giving rise to an azo compound (azoaromatic) or an hydrazo compound (hydrazoaromatic) before its conversion into an amino group. As it is well-known by the skilled person in the art, the reduction of organic nitroaromatics (i.e., nitroderivatives) to other reduced compounds (e.g., nitroso-derivatives, azoaromatics, hydrazoaromatics or amino-derivatives) can be carried out by means of different combinations of reducing agents/mediums [see below in connection with the self-degradable formulation of the invention]

The chemoremediation rate is an important variable in designing a system that is impacted by many factors. Among these factors is the time required for the chemical reagent consortium to adequately access the explosive material. In some embodiments of the present invention, the chemical reagent consortium is separated from the explosive material via a defeatable barrier 20, as demonstrated generally in FIGS. 1-6 below. In some embodiments, the defeatable barrier 20 comprises a biodegradable polymer material that is biodegraded over a period of about six months to about thirty-six months. In other embodiments, the defeatable barrier 20 comprises a polymer or thin, metallic material that is mechanically defeated prior to placing the explosive device for detonation. Specifics regarding the various embodiments of the defeatable barrier 20 will be discussed in connection with each Figure below.

In other embodiments of the present invention, highly explosive materials, such as Pentolite, TNT and PETN, are rendered inert through the action of water expandable materials into non-explosive materials. Virtually any type of water expandable material capable of rendering explosive materials inert is considered to be within the scope of the present invention. The ability of a water expandable material to render an explosive material inert can be assessed by conventional methods, such as, those disclosed, e.g., in the accompanying Examples (e.g., Examples 7 and 14-23). Briefly, in order to assess if a water expandable material is suitable for chemoremediating an explosive material, a sample of said explosive material (e.g., Pentolite, PETN, TNT, etc.) is contacted with said water expandable material to be tested and the sample is monitored until the reaction is deemed complete; following completion, sample residues are dried and tested on a standard BAM impact hammer. If said sample residue is no longer impact sensitive, then the water expandable material may be deemed as a mechanically remediating reagent. The presence of the explosive material (e.g., PETN, TNT, etc.) after chemical remediation can be tested by well known methods, e.g., by high performance liquid chromatography (HPLC), which measures the concentration of a known explosive material, or by testing the impact sensitivity by a Fallhammer apparatus (Example 13).

A "water expandable material" as used herein relates to a compound known for its ability to absorb one or more times its own weight in water, i.e., to increase its initial weight (Wo) until reaching a final weight (Wf) greater than its initial weight (Wo), or for its ability to absorb and increase its initial volume (Vo) until reaching a final volume (Vf) greater than its initial volume (Vo). By illustrative, Wf or Vf can be, at least, 1.1 times Wo or Vf, respectively, typically at least 1.2, 1.3, 1.4, 1.5, 1.6, 1.7, 1.8, 1.9, 2, 5, 10, 15, 25, 50 or 100 times Wo or Vo, respectively, or even more. The affinity of said water expandable material for water and its capacity of absorbing it and increasing its weight and/or volume have a mechanical effect on the explosive material, e.g., the self-degradable (shaped) formulation of the invention, since increasing the volume of the water expandable material causes a breakdown or rupture of said formed (shaped) explosive material, such as a the self-degradable formulation of the invention, which is thus insensitive to the detonator. Therefore, said water expandable material acts as a swelling agent and is responsible for the mechanical remediation or physical-mechanical decomposition of the explosive material. Generally, the actual moisture of the soil or of the subsoil as well as the inclemency of the weather (e.g., rain, snow, etc.), provides with the sufficient amount of water so that the water expandable material increases its weight and/or volume and exerts its swelling action causing the physical-mechanical breakdown or rupture of the explosive material, e.g., the self-degradable formulation of the invention, and, consequently, its degradation; nevertheless, if necessary, a reservoir or a source of water could be included in the explosive material formulation (e.g., self-degradable formulation of the invention) or in the explosive device containing said formulation so that, once a time has passed without the explosive charge being detonated, the physical-mechanical breakdown or rupture of the explosive material takes place. Alternatively, water could be provided by means of irrigation or inundation of the area in which the undetonated explosive devices containing said formulation are located so that their degradation takes place.

Illustrative, non-limiting examples of said water expandable materials capable of mechanically destroying the explosive material include water-swellable polymers (i.e., a particular type of water expandable materials in which the material is a polymer), such as natural or synthetic gums; polymers, preferably hydrophilic polymers known for their ability to absorb one or more times their own weight in water; etc. In a particular embodiment, said water-swellable polymer is a polysaccharide or a derivative thereof, a polymer, such as a homopolymers or a copolymer consisting of polymethacrylates, polyacrylates, poly(acrylic acid), polyacrylamide, polyvinylpyrrolidone, polyvinyl alcohol, polylactic acid, polyalkylene oxides, etc., and mixtures thereof. In a particular embodiment, said water-swellable polymer is selected from the group consisting of starch, albumin, alginate (sodium alginate), agar, amylose, cellulose, chicle gum, gelatin, gellan gum, glucomannan, Arabic gum, guar gum, gum Arabic, karaya gum, locust bean gum, mastic gum, spruce gum, tara gum, tragacanth gum, xanthan gum, cellulose acetate, cellulose triacetate, cellulose acetate ethyl carbamate, cellulose acetate phthalate, cellulose acetate methyl carbamate, cellulose acetate succinate, cellulose acetate dimethyl aminoacetate, cellulose acetate ethyl carbonate, cellulose acetate chloroacetate, cellulose acetate ethyl oxalate, cellulose acetate methyl sulfonate, cellulose acetate butyl sulfonate, cellulose acetate propionate, cellulose acetate diethyl aminoacetate, cellulose acetate octate, cellulose acetate laurate, cellulose acetate p-toluol sulfonate, cellulose acetate butyrate, sodium acrylate, potassium acrylate, alkyl acrylate and chemical equivalents thereof, and mixtures thereof. It is within the scope of the present invention to use any combination of these particular water expandable materials which are capable of rendering the explosive material insensitive to initiation by fragmenting said explosive material into small particles, said particles having a diameter below the critical diameter for detonation sensitivity for said explosive material. Thus, in a particular embodiment, the water expandable material comprises a plurality of water absorbing materials.

Various embodiments of explosives are set forth hereinbelow which are configured to enable chemical reagents to chemoremediate a quantity of explosive material. The chemical reagents are disposed in sufficient proximity to the explosive material that the chemical reagents initiate chemoremediation of the explosive material when the chemical reagents are mobilized. Additionally, other embodiments of explosives are set forth hereinbelow which are configured to enable water expandable materials to mechanically remediate a quantity of explosive material. The water expandable materials are incorporated into the explosive material in an explosive device so that, when the explosive device is exposed to water, the water expandable material is capable of rendering the explosive material insensitive to initiation by any means by virtue of the fact that the explosive material has been fractured into small particles and is thus below the critical diameter sensitivity threshold for the explosive material, whereby if the explosive device is installed at a detonation site and fails to detonate as intended, when the water expandable material is activated, the water expandable material deactivates the explosive device by fracturing the explosive material in situ at the detonation site.

The shelf lives of the explosive material and the chemical reagents and, alternatively, water expandable materials, are increased by delaying the chemoremediation activity of the chemical reagents or the mechanical remediation of the water expandable materials, at least until the explosive is ready to be utilized. Accordingly, some preferred embodiments of the present invention involve the use of chemical reagents or water expandable materials that are temporarily immobilized or have been blocked from contact with the explosive material until the explosive is to be positioned in the ground or until after the explosive is in the ground. Configurations can also be utilized wherein the chemical reagents are initially mobile when positioned relative to the explosive material, thereby enabling the chemical reagents to immediately initiate chemoremediation.

The embodiments of the invention designed to delay the chemoremediation activity of the chemical reagents until a set time utilize a mobilization means for mobilizing the chemical reagents to contact the explosive material. The mobilization means enables the chemical reagents to initiate chemoremediation or continue chemoremediation or the explosive material. Any mobilizing means can be utilized including mechanisms which are primarily mechanical, electrical, chemical or combinations thereof.

Figure 2:
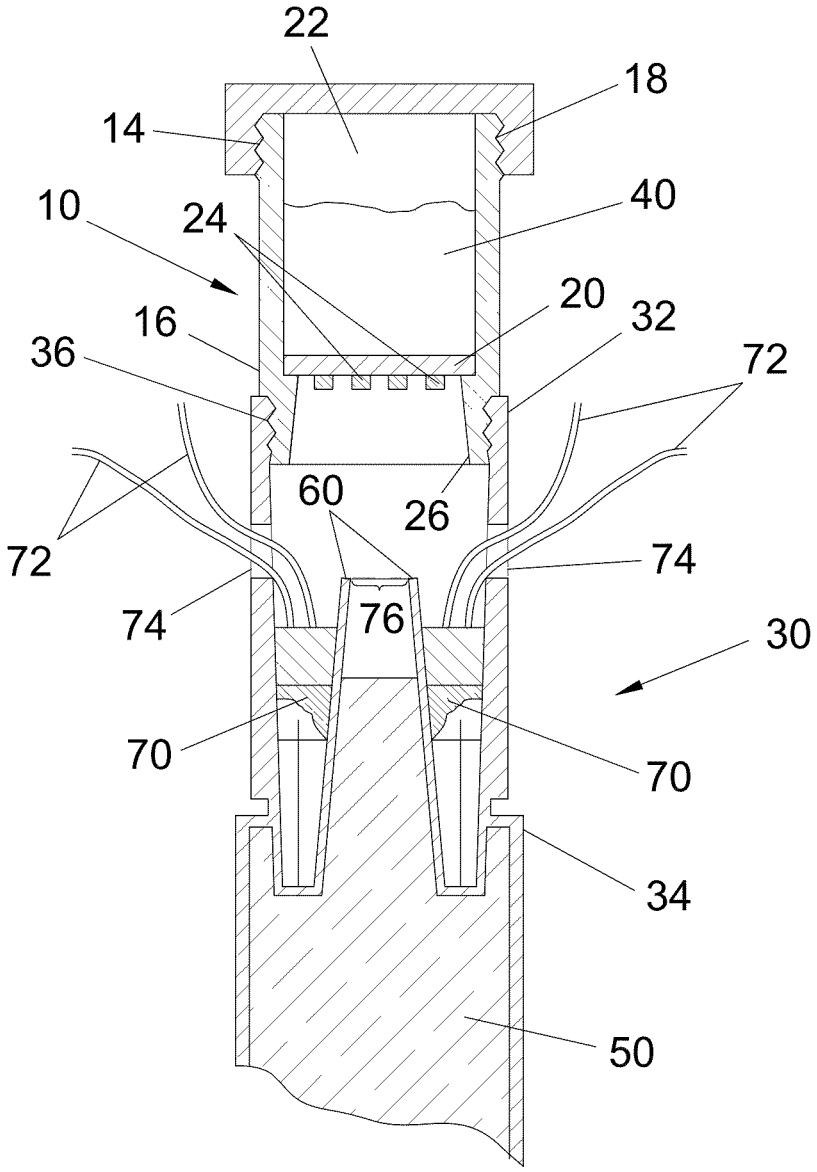
FIG. 2 is a cross-sectioned view of an explosive apparatus and chemoremediation apparatus in accordance with a representative embodiment of the present invention.
Figure 4:
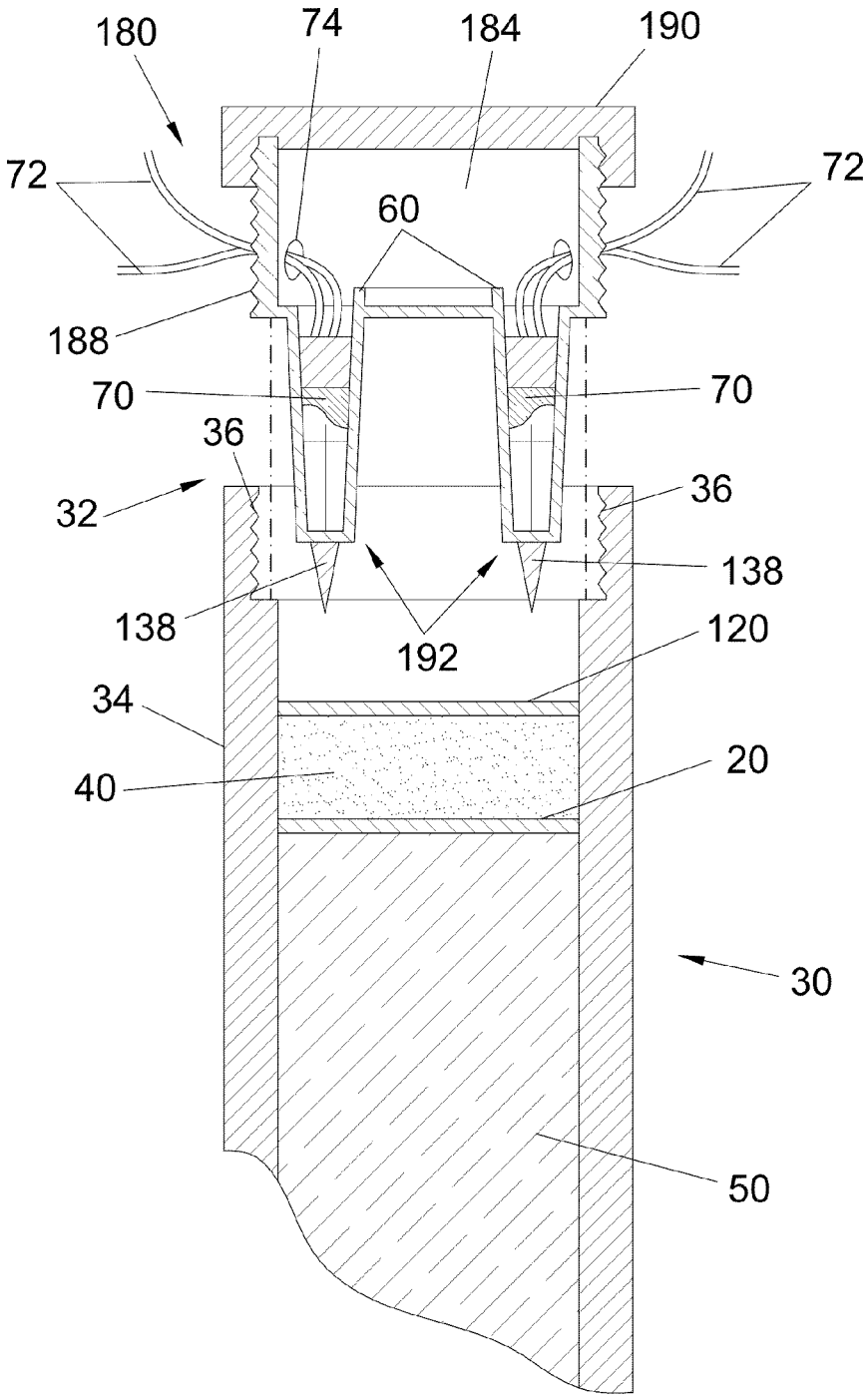
FIG. 4 is an exploded, cross-sectioned view of an explosive apparatus and detonator cap in accordance with a representative embodiment of the present invention.
Figure 5:
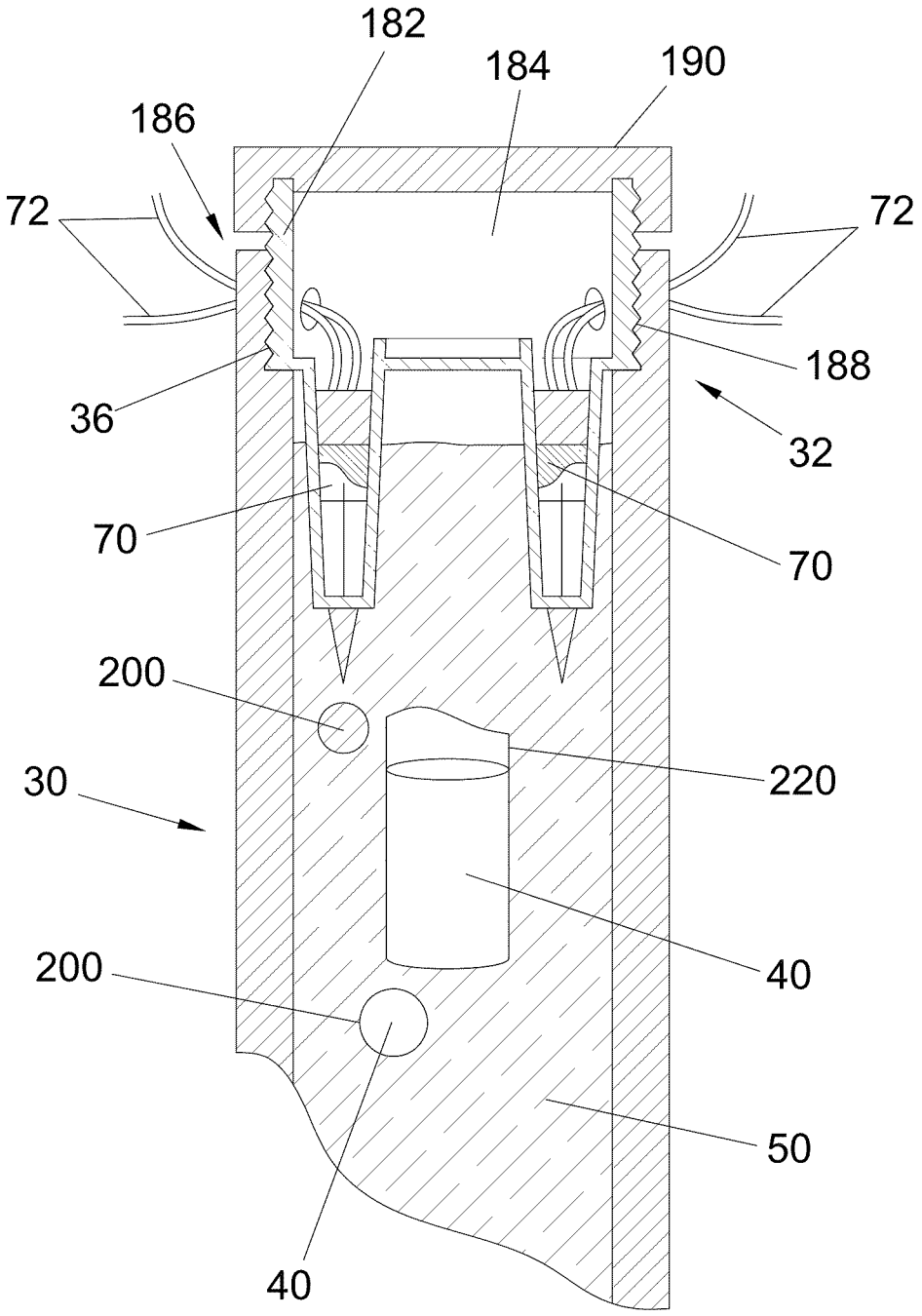
FIG. 5 is a cross-sectioned view of an explosive apparatus and detonator cap in accordance with a representative embodiment of the present invention.
Figure 6:
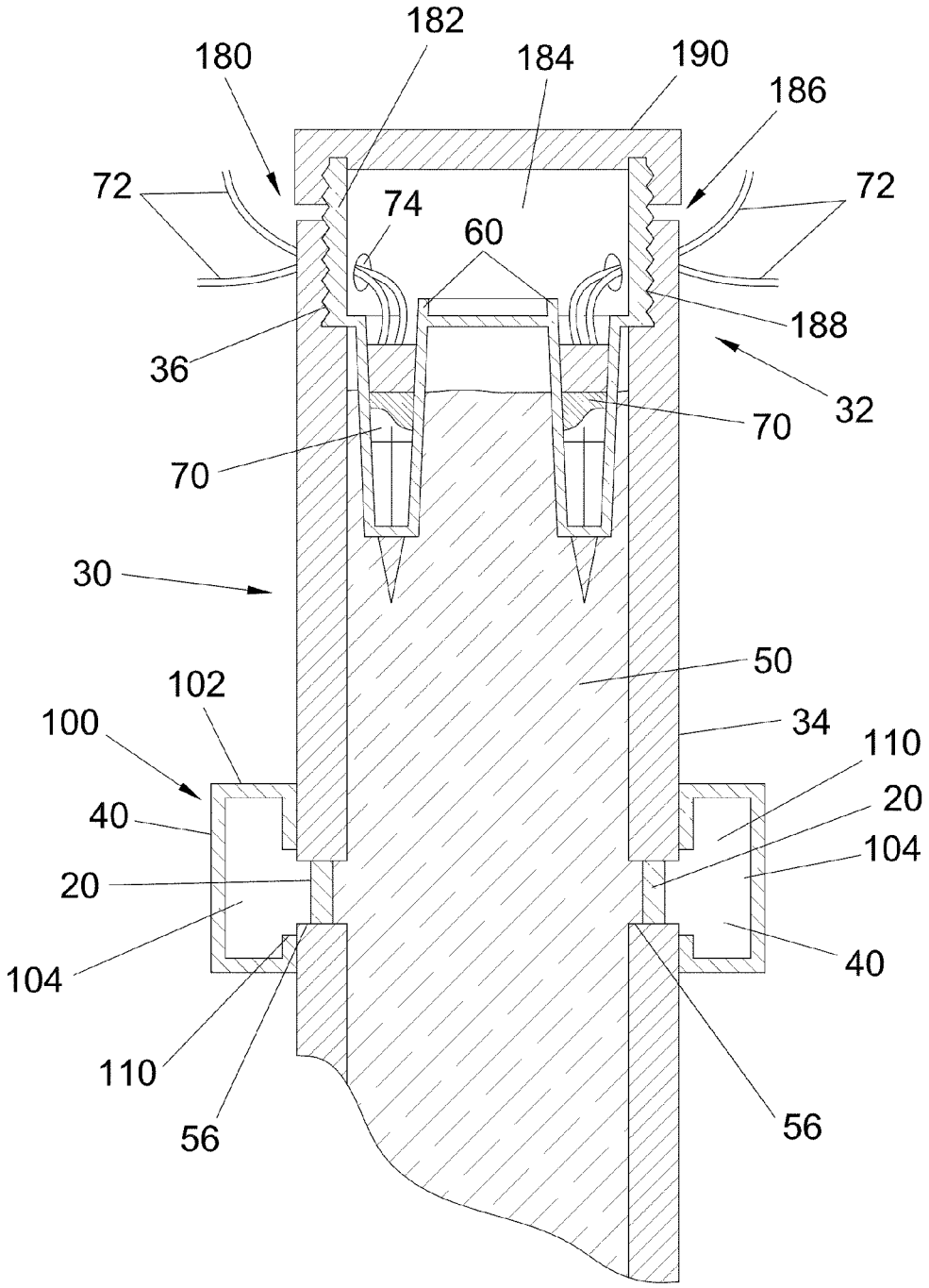
FIG. 6 is a cross-sectioned view of an explosive apparatus and chemoremediation apparatus in accordance with a representative embodiment of the present invention.

Examples of chemical mechanisms utilized to mobilize the chemical reagents are provided by the embodiments in FIGS. 1-2, as well as in FIGS. 5-6. Examples of combinations of mechanical and chemical mechanism utilized to mobilize the chemical reagents are provided by the embodiments in FIGS. 3-4. In these embodiments, a rigid mechanical structure contains the chemical reagents in a relatively immobilized condition or at least separate from the explosive material. Chemoremediation of the explosive material is initiated when a barrier 20 between the chemical reagents and the explosive material is removed and the chemical reagents are brought into direct contact with the explosive material.

Referring now to FIG. 1, an apparatus employing principles of the present invention is shown as an explosive chemoremediation apparatus 10. Chemoremediation apparatus 10 includes a casing 12 having a top end 14 and a bottom end 16. Casing 12 is preferably formed from a material which is water resistant and is capable of withstanding extremes of temperature.

A cap 18 is inserted into top end 14 of casing 12. Cap 18 is preferably formed of a durable material that will withstand being driven down a borehole with a tamping pole. In some embodiments, cap 18 is threadedly coupled to the top end 14 of the casing 12. In other embodiments, cap 18 further includes an internal cap member (not shown) with an O-ring or a foam seal so configured and positioned as to engage top end 14 of casing 12. This configuration further increases the security of the seal produced between cap 18 and the top end 14 of the casing 12.

Cap 18 is but one example of a structure capable of functioning as a cap means for sealing the top end of a casing, such as casing 12. Another example of a structure capable of performing the function of a cap means according to the teachings of the present invention would be a casing without an external cap member, but rather having an internal cap member that is inserted into top end 14. Alternatively, chemoremediation apparatus 10 could be provided with a structure that performs the foundation of such cap means but is integrally formed with casing 12. Any such cap structure that is integrally formed with casing 12 from a plastic material should be constructed to withstand the impacts and pressure encountered in being pushed down a borehole.

Chemoremediation apparatus 10 is configured at bottom end 16 of casing 12 for coupling with an explosive apparatus 30 as housing a bioremediatable explosive material. The bottom end 16 of the chemoremediation apparatus 10 also has casing threads that cooperatively engage correspondingly configured threads on a top end 32 of the explosive apparatus 30 to allow the intended coupling.

According to teachings of the present invention, chemical reagents 40 capable of rendering inert explosive materials are stored in a storage means for releasably containing the chemical reagents 40. By way of example and not limitation, such a storage means within the scope of the present invention can take form of a storage chamber 22 having sidewall defined by the interior walls of casing 12. A bottom end 16 of the casing 12 is generally open or otherwise perforated to readily permit the chemical reagents 40 to mobilize from the storage chamber 22 into the explosive apparatus 30. Thus, barrier 20 is positioned within the bottom end 16 of the casing 12 to provide a bottom wall of the storage chamber 22 thereby temporarily immobilizing the chemical reagents 40 within the storage chamber 22.

Chemical reagents 40 are mobilized from the storage chamber 22 by defeating barrier 20. In some embodiments, barrier 20 comprises a biodegradable polymer material, such as polyhydroxyalkanoates (PHAs). In other embodiments, barrier 20 comprises a thin metallic material, such as tin or aluminum. Finally, in some embodiments barrier 20 comprises a non-biodegradable polymer material.

PHAs are linear, biodegradable polyesters of various hydroxyalkonates. PHAs are most commonly synthesized and intracellularly accumulated by numerous microorganisms as energy reserve material. The mechanical properties of PHAs are highly dependent on the constituting monomer units and molecular weight. More than 150 different monomer units have been identified as the constituents of PHAs. These monomers can be combined to produce materials with extremely different properties, including varying lengths of biodegradation.

PHAs are biopolymers chains comprising variations of the monomer unit as shown in Formula 1. The $R^1$ group of the monomer may be substituted by a wide range of organic molecules. For example, $R^1$ can be substituted with hydrogen or hydrocarbon chains of up to around C13 in length, and n can range from 1 to 3, or more. Therefore, when $R^1$ is a methyl group and n=1, the polymer is poly-(3-hydroxybutyric acid) (PHB). Alternatively, when $R^1$ is a methyl group and n=0, the polymer is polylactic acid (PLA), and when $R^1$ is a hydrogen atom and n=4, the polymer is polycaprolactone. PHAs can include any number of monomers and commonly range from 100 to 30,000 monomers in length with molecular weight ranging from about 500 Daltons (Da) to over 1,000,000 Da.

Diagram 1

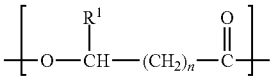

As with other polymers, PHA materials may be extruded into final product shape, dimension, and thickness. In some embodiments, the PHA material is extruded into a sheet having a diameter from about 0.01 millimeters to about 1.50 millimeters.

The chemical reagents 40 are mobilized by gravity into the explosive apparatus 30 upon the biodegradation of barrier 20.

Referring now to FIG. 2, a cross-sectioned view of the chemoremediation apparatus 10 and the explosive apparatus 30 of FIG. 1, are shown. In some embodiments, the bottom end 16 of the casing 12 comprises a plurality of holes or perforations 24. Barrier 20 is positioned within the storage chamber 22 so as to be interposed between the chemical reagents 40 and the plurality of perforations 24. Thus, as barrier 20 biodegrades, the chemical reagents 40 are permitted to bypass the barrier 20 and flow through the plurality of perforations 24 into the explosive apparatus 30. In some embodiments, a moisture present within the chemical reagents 40 activates the biodegradation of barrier 20.

Explosive apparatus 30 comprises a shell 34 having an open top end 32 and an explosive material 50 housed within shell 34. The interior of shell 34 is provided with threads 36 near top end 32. These threads 36 cooperate with correspondingly configured casing threads 26 on chemoremediation apparatus 10. Shell 34 can be formed from distinct components or as an integral structure as shown.

The combination of casing threads 26 and shell threads 36 together serve as an example of a coupling means for coupling a chemoremediation apparatus according to the teachings of the present invention with an explosive apparatus, such as explosive apparatus 30. In the embodiment illustrated, the function of such a coupling means is performed by an extension of casing 12 of chemoremediation apparatus 10 and an extension of shell 34 of explosive apparatus 30. Alternatively configured structures can, however, perform the function of such a coupling means.

For example, a wedge fit can be utilized between chemoremediation apparatus 10 and explosive apparatus 30 using respective angled male and female parts attached, respectively, to each. While the coupling means is primarily a mechanism to join chemoremediation apparatus 10 and explosive apparatus 30, it is within the teaching of the present invention to provide structures that prevent chemoremediation apparatus 10 and explosive apparatus 30 from being unintentionally separated, thereby performing the function of a locking means for securing chemoremediation apparatus 10 and explosive apparatus 30 against the disengagement of the coupling together thereof.

Explosive apparatus 30 further includes a capwell 60 positioned in open end 32 to receive detonators 70. Detonators 70 are in turn electrically connected by wires 72 to the exterior of shell 34 through wire access opening 74. A chemoremediation portal 76 formed through capwell 60 communicates with explosive material 50 to afford access by mobilized chemical reagents 40 from perforations 24 to explosive material 50. Thus, as chemical reagents 40 are released into the explosive apparatus 30, chemical reagents 40 access explosive material 50 via the chemoremediation portal 76.

Figure 3:
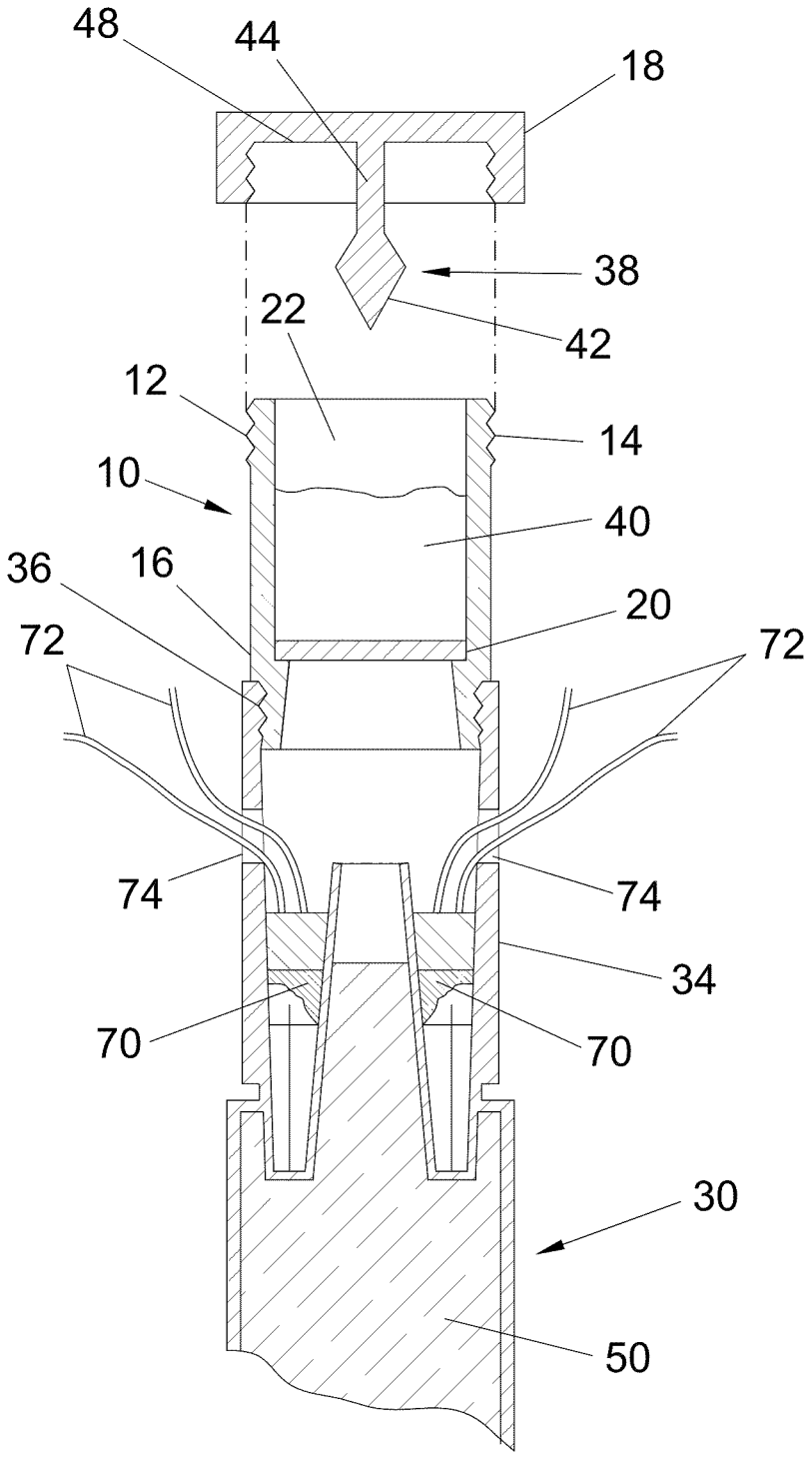
FIG. 3 is an exploded, cross-sectioned view of an explosive apparatus and chemoremediation apparatus incorporating a spike in accordance with a representative embodiment of the present invention.

Referring now to FIG. 3, a cross-sectioned view of the chemoremediation apparatus 10 and the explosive apparatus 30 are shown prior to securing cap 18. In some embodiments, bottom end 16 of storage chamber 22 is entirely open such that only barrier 20 is interposed between chemical reagents 40 and the explosive apparatus 30. A spike 38 formed on an inner surface 48 of the cap 18 is provided to pierce barrier 20 upon securement of the cap 18 onto top end 14 of casing 12. Spike 38 is generally configured to have a head portion 42 and a post portion 44. In some embodiments, head portion 42 comprises a diameter that is greater than post portion 44. As such, in the process of threadedly coupling cap 18 to casing 12, head portion 42 is inserted though barrier 20 providing a chemical reagent portal having a diameter equal to the diameter of head portion 42. When cap 18 is completely threaded onto casing 12, head portion 42 is positioned below barrier 20 such that post portion 44 bisects the chemical reagent portal. The narrower diameter of post portion 44 permits chemical reagents 40 to flow freely through the chemical reagent portal and into explosive apparatus 30. In some embodiments, barrier 20 comprises a biodegradable material as previously discussed. In other embodiments, barrier 20 comprises a metallic or non-biodegradable plastic material capable of being pierced by spike 38.

With reference to FIG. 4, some embodiments of the present invention include a cap 180 configured to house both detonators 70 and accompanying wires 72. Cap 180 comprises a casing 182 having an interior space 184. Cap 180 further includes a capwell 60 positioned within interior space 184 to receive detonators 70. Detonators 70 are in turn electrically connected by wires to the exterior of cap 180 through wire access openings 74. An open end 186 of cap 180 is provided to enable loading of detonators 70 and accompanying wires 72. Once detonators 70 are installed, open end 186 is sealed or closed by sub-cap 190 which is threadedly coupled to threads 188 of cap 180. Cap 180 is then threadedly coupled to explosive apparatus 30 via threads 188 of cap 180 and threads 36 of shell 34. In some embodiments, sub-cap 190 is cemented or otherwise adhered to cap 180 rather than coupled via threads 188. In other embodiments, cap 180 is cemented or otherwise adhered to explosive apparatus 30 rather than coupled via complementary threads 188 and 36. Finally, in some embodiments sub-cap 190 further includes wire access openings (not shown) through which wires 72 extend to the exterior of cap 180.

In some embodiments, chemical reagents 40 are interposedly positioned between open, top end 32 of explosive apparatus 30 and explosive materials 50. A first barrier 20 is interposedly positioned between chemical reagents 40 and explosive materials 50 to prevent premature chemoremediation. In some embodiments, a second barrier 120 is interposedly positioned between chemical reagents 40 and top end 32 so as to retain chemical reagents 40 within explosive apparatus 30. In other embodiments, second barrier 120 protects chemical reagents 40 from exposure to moisture or oxygen via top end 32.

A spike 138 formed on a bottom end 192 of cap 180 is provided to pierce first and second barriers 20 and 120 during the process of coupling cap 180 to explosive device 30. Spike 138 is advanced through chemical reagents 40 and into explosive materials 50. In some embodiments, the process of threadedly coupling cap 180 to explosive apparatus 30 causes bottom end 192 of cap 180 to admix chemical reagents 40 with explosive materials 50. In other embodiments, spike 138 and bottom end 192 provide chemoremediation portals (not shown) through barrier 20 whereby chemical reagents 40 access explosive materials 50 over a period of time.

Referring now to FIG. 5, a cross-sectioned view of a cap 180 threadedly coupled to an explosive apparatus 30 is shown. In some embodiments, chemical reagents 40 are first encapsulated in a barrier package 220 and then disposed within explosive materials 50. Barrier package 220 generally comprises a biodegradable material that is biodegraded over a period of about six months to about thirty-six months. As barrier package 220 degrades, chemical reagents 40 are released and begin chemoremediating explosive materials 50, in accordance with the present invention.

In some embodiments, a water expandable material 200 is cast into the explosive material 50, or inserted into the explosive material 50 via one or more capsules. Illustrative, non-limiting examples of water expandable materials may include, as mentioned above, acrylic acid derivatives and gums, e.g., natural or synthetic gums, such as xanthan gum, guar gum and/or sodium acrylate, potassium acrylate or an alkyl acrylate, etc. The expandable material and/or capsule containing the expandable material is configured to become permeable to water after a predetermined period of time, such as after a period of about six months to about thirty-six months. Following exposure to water, the expandable material 200 expands thereby breaking the explosive material 50 into a multiplicity of small fragments, each fragment being below the critical diameter required for detonation sensitivity. In other embodiments, chemical reagents 40 are combined with the expandable material 200 such that the explosive material 50 is both fragmented and rendered harmless.

Referring now to FIG. 6, a chemoremediation sleeve 100 is depicted in combination with explosive apparatus 30. In some embodiments, shell 34 comprises a plurality of annularly configured holes or slots 56 over which a chemoremediation sleeve 100 is positioned. An inner diameter of sleeve 100 is configured to compatibly receive an outer diameter of explosive apparatus 30. In some embodiments, sleeve 100 and explosive apparatus 30 are coupled via an adhesive or cement. In other embodiments, sleeve 100 and explosive apparatus 30 are coupled via friction or a threaded interface.

Sleeve 100 comprises a casing 102 having an interior facing opening or window 110. Sleeve 100 further comprises an interior space 104 configured to store a chemical reagent 40, in accordance with the present invention. In some embodiments, sleeve 100 is coupled to explosive apparatus 30 such that windows 110 are substantially aligned with the plurality of annularly configured holes 56. A barrier 20 is further interposed between chemical reagents 40 and explosive material 50. In some embodiments, barrier 20 is inserted into each of the plurality of annularly configured holes 56. In other embodiments, windows 110 further include barrier 20 so as to retain chemical reagent 40 within interior space 104.

Figure 7:
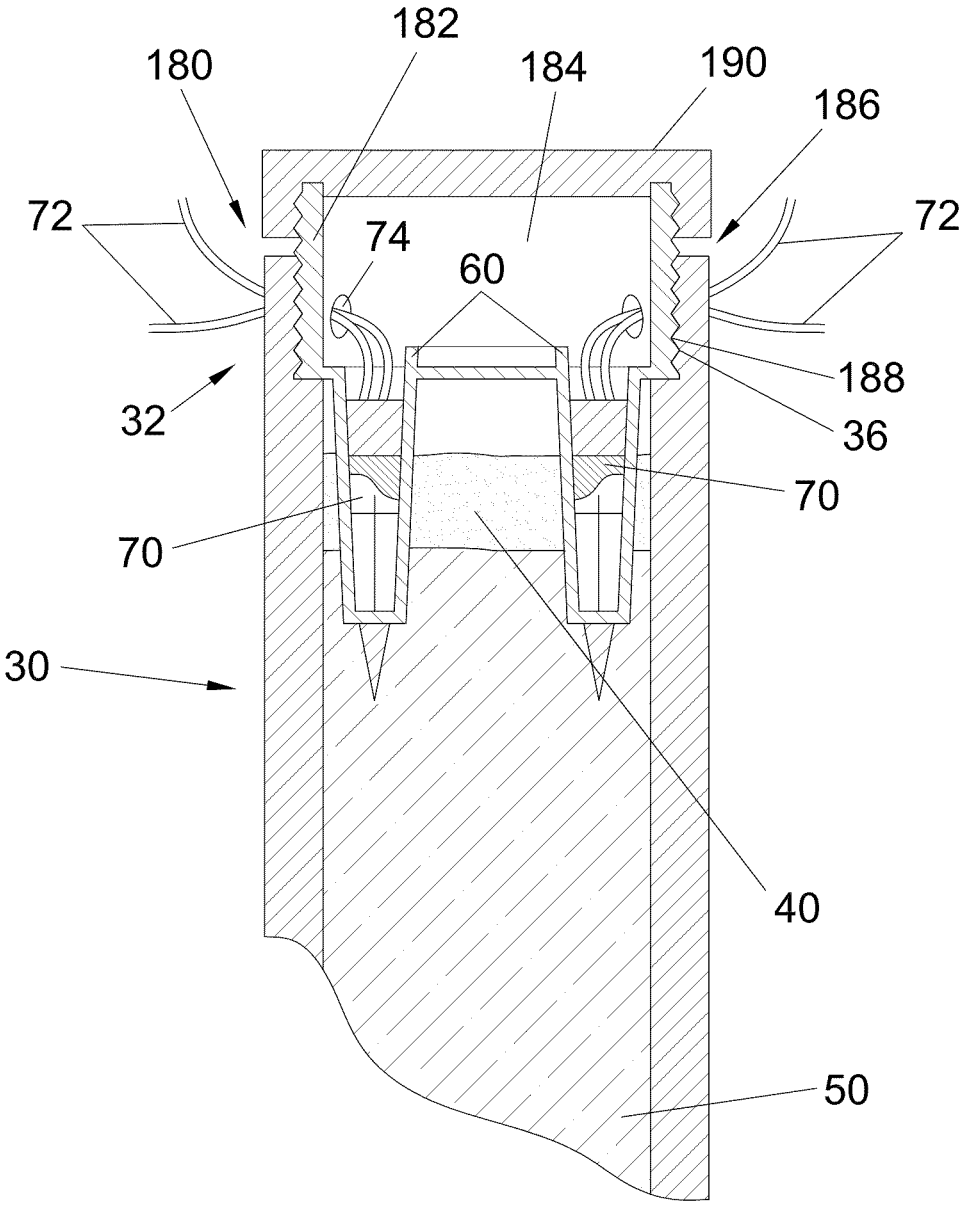
FIG. 7 is a cross-sectioned view of an explosive apparatus and detonator cap in accordance with a representative embodiment of the present invention.

Referring now to FIG. 7, a cross-sectioned view of an explosive apparatus 30 and coupled detonator cap 180 is shown. In some embodiments, chemical reagents 40 are directly deposited on top of explosive material 50. Accordingly, in the event that explosive apparatus 30 fails to detonate, chemical reagents 40 are concentrated at the portion of explosive material 50 around detonators 70. Where chemical reagents 40 are deposited directly on top of explosive material 50, the chemoremediative activity of chemical reagents 40 is selected to provide sufficient time to set and detonate explosive apparatus 30 prior to chemoremediation of explosive materials 50.

Figure 8:
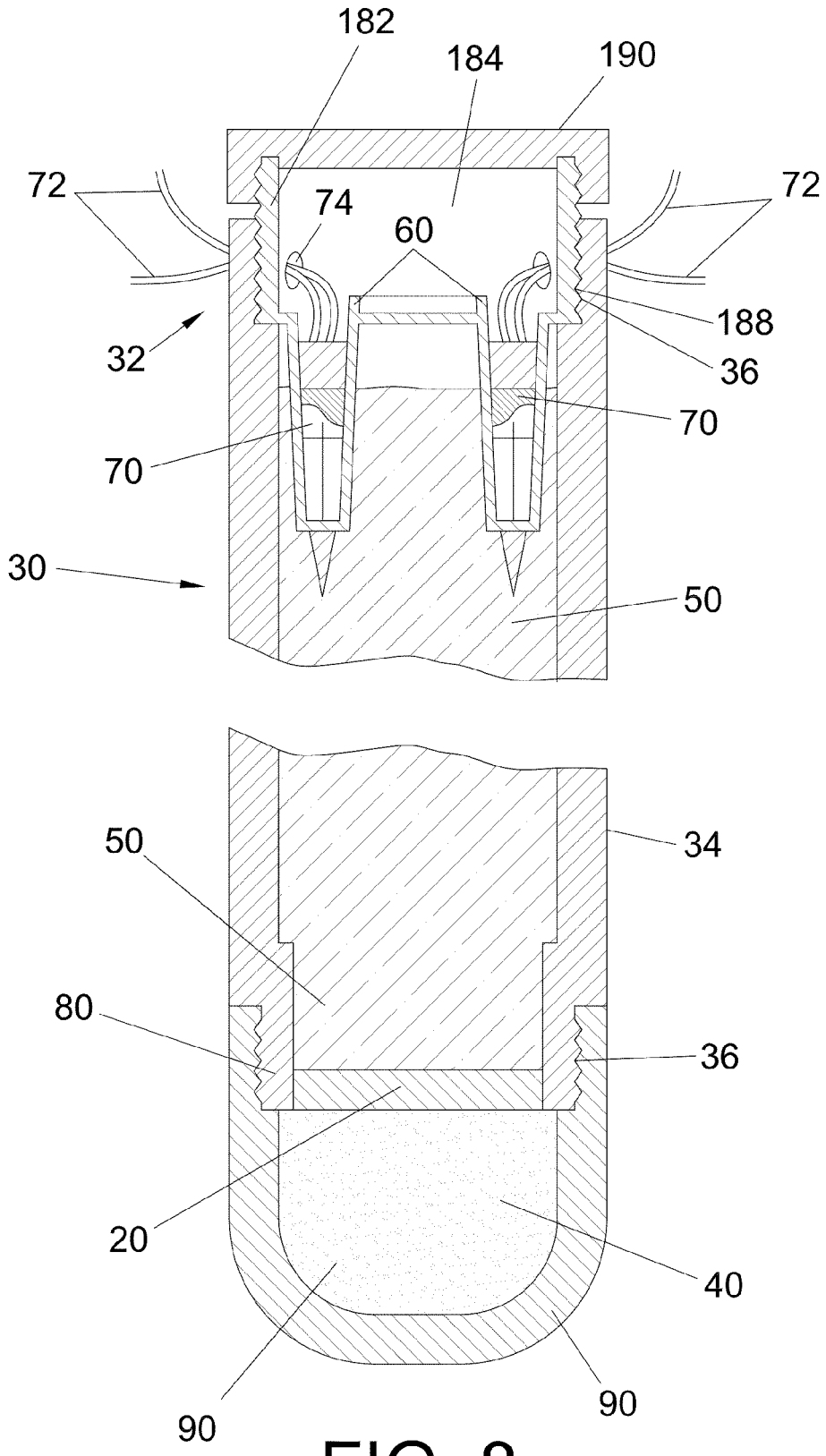
FIG. 8 is a cross-sectioned view of an explosive apparatus and removable tip in accordance with a representative embodiment of the present invention.

With reference now to FIG. 8, a cross-sectioned view of explosive apparatus 30 is shown. In some embodiments, terminal end 80 of the explosive apparatus 30 is further modified to accommodate removable tip 90. Removable tip 90 is attached to the explosive apparatus 30 via a set of compatible threads 36. Alternatively, in some embodiments the removable tip 90 is coupled to the explosive apparatus via an adhesive, friction or another method of attachment as known in the art. Removable tip 90 comprises an interior space 92 configured to store the chemical reagents 92. The terminal end 80 of the apparatus 30 is further modified to include barrier 20 to retain explosive material 50 within shell 34 of the explosive apparatus 30. Thus, when removable tip 90 is coupled to terminal end 80 of the explosive apparatus 30, barrier 20 is interposedly positioned between explosive material 50 and chemical reagents 40. As discussed above, the chemoremediative activity of chemical reagents 40 is selected to provide sufficient time to set and detonate explosive apparatus 30 prior to chemoremediation of explosive materials 50. In some embodiments, removable tip 90 further includes a spike (not shown) positioned so as to pierce barrier 20 upon the coupling of removable tip 90 and explosive apparatus 30.

Figure 9:
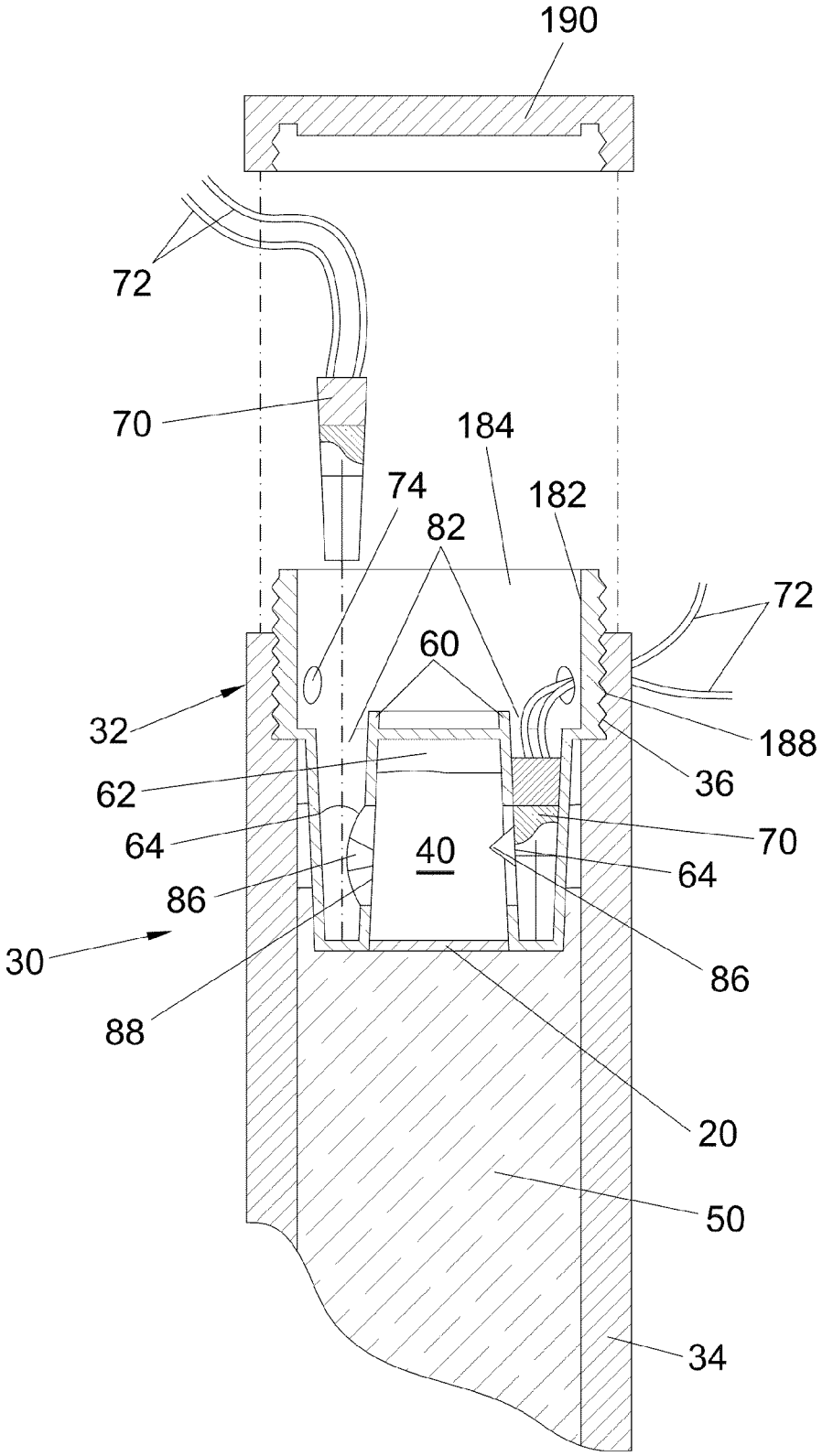
FIG. 9 is a cross-sectioned view of an explosive apparatus and detonator cap incorporating a moisture barrier in accordance with a representative embodiment of the present invention.
Figure 10:
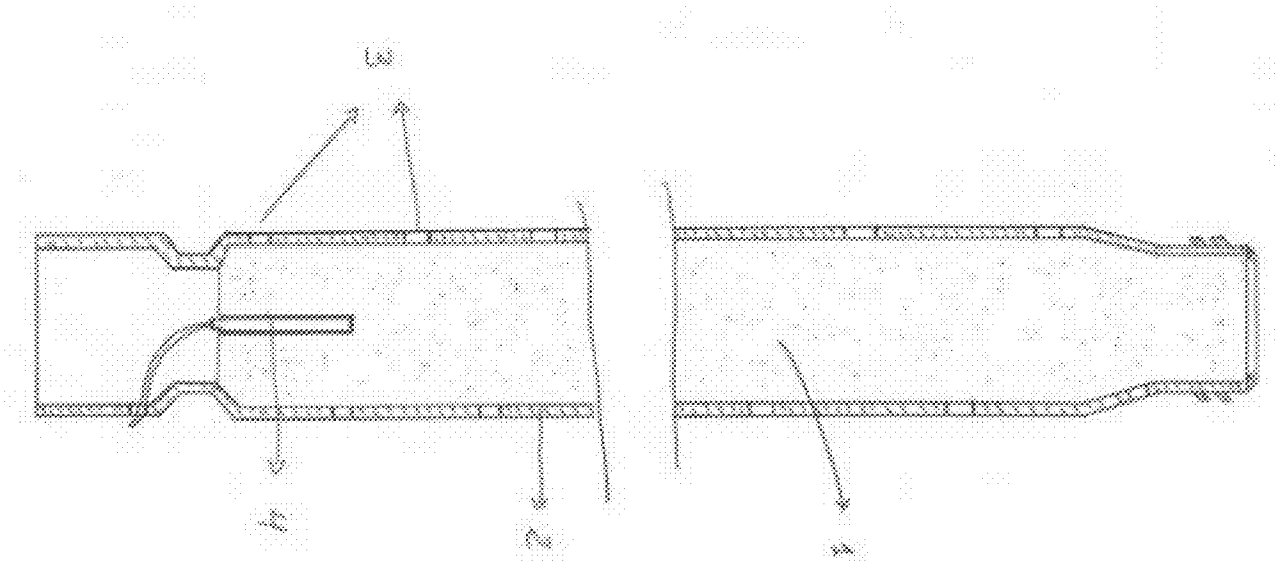
FIG. 10 is a schematic depiction of an explosive device provided by this invention comprising a shell (2) provided with side holes (3) for housing a self-degradable formulation of the invention (1), in which an initiation system or detonator (4) is housed.
Figure 11:
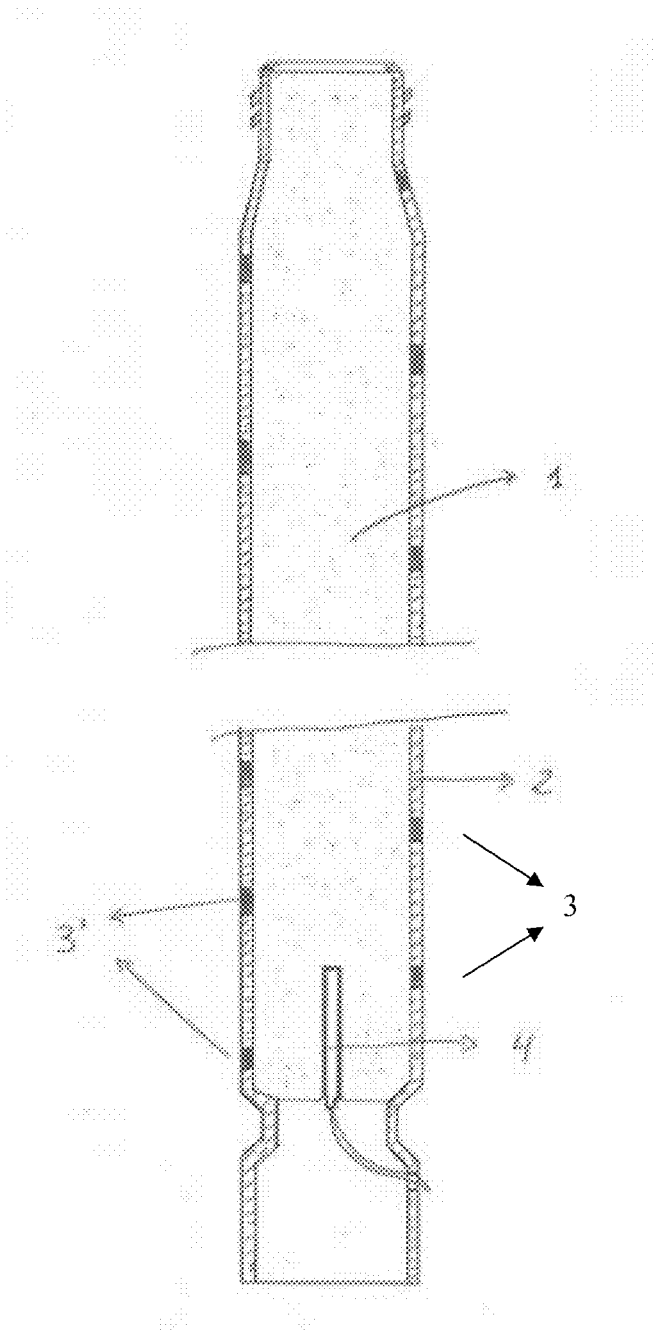
FIG. 11 is a schematic depiction of a variant of an explosive device provided by this invention in which the holes (3) of the shell (2) housing a self-degradable formulation of the invention (1) are sealed with a water-porous or water-soluble material (3').

Referring now to FIG. 9, an exploded, cross-sectioned view of explosive apparatus 30 is shown. In some embodiments, capwell 60 further includes internal chamber 62 into which chemical reagents 40 are inserted. Chemical reagents 40 are retained within internal chamber 62 via barrier 20. In some embodiments, barrier 20 is provided so as to be interposed between chemical reagents 40 and explosive material 50.

In some embodiments, chemical reagents 40 are activated by water. Thus, in some embodiments internal chamber 62 is lined with moisture barrier 88. Moisture barrier 88 is provided to prevent undesired exposure of chemical reagents 40 to water. In some embodiments, exposure of water into internal chamber 62 results in release of chemical reagents 40 into explosive material 50. For example, in some embodiments water-activated chemical reagents 40 become chemically reactive thereby being enabled to defeat barrier 20. In other embodiments, barrier 20 is defeated upon direct exposure to water. For any embodiment, once barrier 20 is defeated, chemical reagents 40 are released into explosive materials 50. Accordingly, moisture barrier 88 is provided to prevent exposure of water into either chemical reagents 40 or barrier 20.

In some embodiments, moisture barrier 88 comprises a material that biodegrades over time. In other embodiments, moisture barrier 88 comprises a material that is chemically reactive with chemical reagents 40, whereby moisture barrier 88 is eventually defeated via contact with chemical reagents 40.

In some embodiments, inner wall portion 64 of capwell 60 is inwardly biased so as to protrude into detonator receptacle 82. Wall portion 64 further comprises spike 86 interposed between wall portion 64 and moisture barrier 88. Thus, as detonator 70 is inserted into detonator receptacle 82, inner wall portion 64 is outwardly biased, thereby driving spike 86 into and through moisture barrier 88. Accordingly, spike 86 provides moisture access to chemical reagents 40 and barrier 20 located within internal chamber 62.

In a particular embodiment, the invention relates to an explosive device capable of self-remediation, if the explosive device fails to detonate as intended, the explosive device comprising:

a casing having an inner lumen;

a quantity of explosive material deposited into the inner lumen of the casing;

a quantity of chemical reagent positioned in such proximity to the quantity of explosive material that, when the quantity of the chemical reagent is mobilized, the chemical reagent in the quantity thereof is capable of chemoremediating the quantity of explosive material in the lumen of the casing; and means for detonating the explosive material of the explosive device.

The particulars of the casing have been previously disclosed when referring to the different embodiments of the explosive apparatus shown in the accompanying figures. The casing has an inner lumen wherein a quantity of an explosive material is deposited therein.

The explosive material which can be deposited into the inner lumen of the casing according to this particular embodiment can be a chemoremediable explosive, including, but not limiting to, halocarbons, hydrocarbons, organic nitroaromatics, organic nitramines, and organic nitric esters. In a particular embodiment, said explosive material is selected from the group consisting of trinitrotoluene, hexanitrostilbene, hexanitroazobenzene, diaminotrinitrobenzene, triaminotrinitrobenzene, cyclotri-methylene trinitramine, cyclotetramethylene trinitramine, nitroguanidine, 2,4,6-trinitrophenylmethylnitramine, hexanitrohexaazaisowurtzitane, pentaerythritol tetranitrate, nitroglycerine, nitrocellulose, ethylene glycol dinitrate, halocarbons, hydrocarbons and mixtures thereof.

A quantity of chemical reagent is positioned in the proximity to the quantity of explosive material, namely, in such proximity that, when the quantity of the chemical reagent is mobilized, the chemical reagent in the quantity thereof is capable of chemoremediating the quantity of explosive material in the lumen of the casing.

As mentioned above, virtually any chemical reagent capable of rendering explosive materials inert is considered to be within the scope of the present invention. Illustrative, non-limiting examples of chemical reagents that have been demonstrated to exhibit that capacity include the group consisting of calcium carbonate, sodium hydroxide, potassium hydroxide, calcium hydroxide, lithium hydroxide, magnesium hydroxide, beryllium hydroxide, cesium hydroxide, barium hydroxide, francium hydroxide, rubidium hydroxide, strontium hydroxide, radium hydroxide, ammonium hydroxide, ferrous chloride, stannous chloride, ferrous sulfate, and chemical equivalents thereof. Additional chemical reagents capable of converting a explosive material in a non-explosive material include those reagents mentioned below in connection with the self-degradable formulation of the invention, for example, reducing agents of the nitro, nitrate or nitramino groups. It is within the scope of the present invention to use any combination of these particular chemical reagents that are determined to be capable of chemoremediating explosive materials. Thus, in a particular embodiment, the chemical reagent comprises a plurality of chemical reagents.

The chemical reagent, if desired, can be contained in a capsule. Thus, in a particular embodiment, the explosive device further comprises a capsule for containing the chemical reagent in proximity to the explosive material. The particulars of the capsule have been previously disclosed when referring to the different embodiments of the explosive apparatus shown in the accompanying figures. The capsule material may include any material configured to permit an interaction between the chemical reagent and the explosive material in the explosive device. In a particular embodiment, the capsule is biodegradable and comprises a biodegradable material, such as a biodegradable paper or polymer material.

The chemical reagent and the explosive material, if desired, can be separated by means of a barrier; thus, in a particular embodiment, the explosive device further comprises a barrier interposedly positioned between the chemical reagent and the explosive material. The particulars of said barrier have been previously disclosed when referring to the different embodiments of the explosive chemoremediation apparatus shown in the accompanying figures. The barrier material may include any material configured to permit selective interaction between a chemical reagent and the explosive material of the explosive device. In a particular embodiment, the barrier comprises a biodegradable material, such as a biodegradable paper or polymer material, whereas in another particular embodiment, a puncturable barrier comprised of a paper material, a metallic material, and/or a polymeric material can be used. Preferably, the barrier is biodegradable. Said barrier can be removable mechanically, or removable electrically or removable chemically.

Means for detonating the explosive material of the explosive device include, but are not limited to detonators.

As mentioned above, the explosive device is configured to enable chemical reagents to chemoremediate a quantity of explosive material. So, the chemical reagents are disposed in sufficient proximity to the explosive material that the chemical reagents initiate chemoremediation of the explosive material when the chemical reagents are mobilized. Thus, in a particular embodiment, the explosive device comprises a mobilization means for mobilizing the chemical reagents to contact the explosive material. The mobilization means enables the chemical reagents to initiate chemoremediation or continue chemoremediation of the explosive material. Any mobilizing means can be utilized including mechanisms which are primarily mechanical, electrical, chemical or combinations thereof.

In another embodiment, the invention relates to a method for manufacturing an explosive device capable of self-remediation, if the explosive device fails to detonate as intended, the method comprising the steps:

forming a quantity of an explosive material into an explosive device;

identifying a chemical reagent capable of chemoremediating the explosive material; and positioning a quantity of the chemical reagent in such proximity to the quantity of explosive material in the explosive device that, when the quantity of the chemical reagent is mobilized, the chemical reagent in the quantity thereof is capable of chemoremediating the quantity of the explosive material in the explosive device, whereby if the explosive device is installed at a detonation site and fails to detonate as intended, when the quantity of chemical reagent is mobilized, the chemical reagent in the quantity thereof deactivates the explosive device by chemoremediating the quantity of the explosive material in situ at the detonation site.

The explosive material which can be formed into the explosive device according to this particular embodiment can be a chemoremediable explosive, including, but not limiting to, halocarbons, hydrocarbons, organic nitroaromatics, organic nitramines, and organic nitric esters. In a particular embodiment, said explosive material is selected from the group consisting of trinitrotoluene, hexanitrostilbene, hexanitroazobenzene, diaminotrinitrobenzene, triaminotrinitrobenzene, cyclotri-methylene trinitramine, cyclotetramethylene trinitramine, nitroguanidine, 2,4,6-trinitrophenylmethylnitramine, hexanitrohexaazaiso-wurtzitane, pentaerythritol tetranitrate, nitroglycerine, nitrocellulose, ethylene glycol dinitrate, halocarbons, hydrocarbons and mixtures thereof.

Virtually any chemical reagent capable of rendering explosive materials inert can be used in the above method. Illustrative, non-limiting examples of chemical reagents that have been demonstrated to exhibit that capacity include the group consisting of calcium carbonate, sodium hydroxide, potassium hydroxide, calcium hydroxide, lithium hydroxide, magnesium hydroxide, beryllium hydroxide, cesium hydroxide, barium hydroxide, francium hydroxide, rubidium hydroxide, strontium hydroxide, radium hydroxide, ammonium hydroxide, ferrous chloride, stannous chloride, ferrous sulfate, and chemical equivalents thereof. Additional chemical reagents capable of converting a explosive material in a non-explosive material include those reagents mentioned below in connection with the self-degradable formulation of the invention, for example, reducing agents of the nitro, nitrate or nitramino groups. It is within the scope of the present invention to use any combination of these particular chemical reagents that are determined to be capable of chemoremediating explosive materials. Thus, in a particular embodiment, the chemical reagent comprises a plurality of chemical reagents.

The chemical reagent, if desired, can be stored in a capsule, and the capsule can be placed, preferably, in proximity to the explosive material. Thus, in a particular embodiment, the above method further comprises the step of storing the chemical reagent in a capsule, the capsule being placed in proximity to the explosive material. The particulars of the capsule have been previously disclosed when referring to the different embodiments of the explosive apparatus shown in the accompanying figures. The capsule material may include any material configured to permit an interaction between the chemical reagent and the explosive material in the explosive device. In a particular embodiment, the capsule is biodegradable and comprises a biodegradable material, such as a biodegradable paper or polymer material. If the chemical reagent is stored in a capsule, and the capsule is placed in proximity to the explosive material, the above method further comprises the step of opening the capsule to mobilize the chemical reagent.

The chemical reagent and the explosive material, if desired, can be separated by means of a barrier; thus, in a particular embodiment, the above method comprises the step of interposing a barrier between the chemical reagent and the explosive material. The particulars of said barrier have been previously disclosed when referring to the different embodiments of the explosive devices shown in the accompanying figures. Said barrier can be removable mechanically, or removable electrically or removable chemically. The barrier material may include any material configured to permit selective interaction between a chemical reagent and the explosive material of the explosive device. In a particular embodiment, the barrier comprises a biodegradable material, such as a biodegradable paper or polymer material, whereas in another particular embodiment, a puncturable barrier comprised of a paper material, a metallic material, and/or a polymeric material can be used. Preferably, the barrier is biodegradable.

As mentioned above, the above method is designed to enable chemical reagents to chemoremediate a quantity of explosive material. So, the chemical reagents are disposed in sufficient proximity to the explosive material that the chemical reagents initiate chemoremediation of the explosive material when the chemical reagents are mobilized. Then, if the explosive device is installed at a detonation site and fails to detonate as intended, when the quantity of chemical reagent is mobilized, the chemical reagent in the quantity thereof deactivates the explosive device by chemoremediating the quantity of the explosive material in situ at the detonation site. In a particular embodiment, the explosive device comprises a mobilization means for mobilizing the chemical reagents to contact the explosive material. The mobilization means enables the chemical reagents to initiate chemoremediation or continue chemoremediation of the explosive material. Any mobilizing means can be utilized including mechanisms which are primarily mechanical, electrical, chemical or combinations thereof.

In another particular embodiment, the invention relates to an explosive device capable of self-remediation, if the explosive device fails to detonate as intended, the explosive device comprising:

a casing having an inner lumen;

a quantity of explosive material deposited into the inner lumen of the casing;

a quantity of a water expandable material positioned in such proximity or contact to the quantity of explosive material that, when the explosive device is exposed to water, the water expandable material in the quantity thereof is capable of rendering the explosive material insensitive to initiation by fragmenting said explosive material into small particles, said particles having a diameter below the critical diameter for detonation sensitivity for said explosive material deposited into the inner lumen of the casing; and means for detonating the explosive material of the explosive device.

The particulars of the casing have been previously disclosed when referring to the different embodiments of the explosive apparatus shown in the accompanying figures. The casing has an inner lumen wherein a quantity of an explosive material is deposited therein.

The explosive material which can be deposited into the inner lumen of the casing can be a remediable explosive, for example a chemoremediable explosive and/or a mechanically remediable explosive, including, but not limiting to, halocarbons, hydrocarbons, organic nitroaromatics, organic nitramines, and organic nitric esters explosives. In a particular embodiment, said explosive material is selected from the group consisting of trinitrotoluene, hexanitrostilbene, hexanitroazobenzene, diaminotrinitrobenzene, triaminotrinitrobenzene, cyclotri-methylene trinitramine, cyclotetramethylene trinitramine, nitroguanidine, 2,4,6-trinitrophenylmethylnitramine, hexanitrohexaazaisowurtzitane, pentaerythritol tetranitrate, nitroglycerine, nitrocellulose, ethylene glycol dinitrate, halocarbons, hydrocarbons and mixtures thereof.

A quantity of a water expandable material positioned in such proximity, or in contact with, to the quantity of explosive material. Virtually any water expandable material capable of mechanically destroying the explosive material can be used in the above method. Illustrative, non-limiting examples of said water expandable materials capable of destroying the explosive material include water-swellable polymers, such as natural or synthetic gums; polymers, preferably hydrophilic polymers known for their ability to absorb one or more times their own weight in water; etc. In a particular embodiment, said water-swellable polymer is a polysaccharide or a derivative thereof, a polymer, such as a homopolymers or a copolymer consisting of polymethacrylates, polyacrylates, poly(acrylic acid), polyacrylamide, polyvinylpyrrolidone, polyvinyl alcohol, polylactic acid, polyalkylene oxides, etc., and mixtures thereof. In a particular embodiment, said water-swellable polymer is selected from the group consisting of starch, albumin, alginate (sodium alginate), agar, amylose, cellulose, chicle gum, gelatin, gellan gum, glucomannan, Arabic gum, guar gum, gum Arabic, karaya gum, locust bean gum, mastic gum, spruce gum, tara gum, tragacanth gum, xanthan gum, cellulose acetate, cellulose triacetate, cellulose acetate ethyl carbamate, cellulose acetate phthalate, cellulose acetate methyl carbamate, cellulose acetate succinate, cellulose acetate dimethyl aminoacetate, cellulose acetate ethyl carbonate, cellulose acetate chloroacetate, cellulose acetate ethyl oxalate, cellulose acetate methyl sulfonate, cellulose acetate butyl sulfonate, cellulose acetate propionate, cellulose acetate diethyl aminoacetate, cellulose acetate octate, cellulose acetate laurate, cellulose acetate p-toluol sulfonate, cellulose acetate butyrate, sodium acrylate, potassium acrylate, alkyl acrylate and chemical equivalents thereof, and mixtures thereof. It is within the scope of the present invention to use any combination of these particular water expandable materials which are capable of rendering the explosive material insensitive to initiation by fragmenting said explosive material into small particles, said small particles having a diameter below the critical diameter for detonation sensitivity for said explosive material. Thus, in a particular embodiment, the water expandable material comprises a plurality of water expandable materials.

If desired, the water expandable material can be contained in a capsule. Thus, in a particular embodiment, the explosive device further comprises a capsule for containing the water expandable material in contact with, or in proximity to, the explosive material. The particulars of the capsule have been previously disclosed when referring to the different embodiments of the explosive apparatus shown in the accompanying figures. The capsule material may include any material configured to permit an interaction between the water expandable material and the explosive material in the explosive device. In a particular embodiment, the capsule is biodegradable and comprises a biodegradable material, such as a biodegradable paper or polymer material.

Means for detonating the explosive material of the explosive device include, but are not limited to detonators.

As mentioned above, the explosive device is configured to enable water expandable materials to mechanically remediate a quantity of explosive material. So, the water expandable material is disposed in contact with, or in sufficient proximity to, the explosive material so that the water expandable material initiate the mechanical remediation of the explosive material when the explosive device is exposed to water, the water expandable material absorbs water, expands and fragments the explosive material into small particles, said small particles having a diameter below the critical diameter for detonation sensitivity for said explosive material, thus enabling to initiate (or continue) mechanical remediation of the explosive material.

In another aspect, the invention relates to a method for manufacturing an explosive device capable of self-remediation, if the explosive device fails to detonate as intended, the method comprising the steps:

forming a quantity of an explosive material into an explosive device;

identifying a water expandable material, said water expandable material being capable of mechanically destroying the explosive material; and incorporating a quantity of the water expandable material into the explosive material in the explosive device so that, when the explosive device is exposed to water, the water expandable material in the quantity thereof is capable of rendering the explosive material insensitive to initiation by fragmenting said explosive material into small particles, said small particles having a diameter below the critical diameter sensitivity threshold for said explosive material, whereby if the explosive device is installed at a detonation site and fails to detonate as intended, when the quantity of water expandable material is activated, the water expandable material in the quantity thereof deactivates the explosive device by fracturing the quantity of explosive material in situ at the detonation site.

The explosive material which can be formed into said explosive device can be a remediable explosive, for example a chemoremediable explosive and/or a mechanically remediable explosive, including, but not limiting to, halocarbons, hydrocarbons, organic nitroaromatics, organic nitramines, and organic nitric esters explosives. In a particular embodiment, said explosive material is selected from the group consisting of trinitrotoluene, hexanitrostilbene, hexanitroazobenzene, diaminotrinitrobenzene, triaminotrinitrobenzene, cyclotri-methylene trinitramine, cyclotetramethylene trinitramine, nitroguanidine, 2,4,6-trinitrophenylmethylnitramine, hexanitrohexaazaiso-wurtzitane, pentaerythritol tetranitrate, nitroglycerine, nitrocellulose, ethylene glycol dinitrate, halocarbons, hydrocarbons and mixtures thereof.

Virtually any water expandable material capable of mechanically destroying the explosive material can be used in the above method. Illustrative, non-limiting examples of said water expandable materials capable of destroying the explosive material include water-swellable polymers, such as natural or synthetic gums; polymers, preferably hydrophilic polymers known for their ability to absorb one or more times their own weight in water; etc. In a particular embodiment, said water-swellable polymer is a polysaccharide or a derivative thereof, a polymer, such as a homopolymers or a copolymer consisting of polymethacrylates, polyacrylates, poly(acrylic acid), polyacrylamide, polyvinylpyrrolidone, polyvinyl alcohol, polylactic acid, polyalkylene oxides, etc., and mixtures thereof. In a particular embodiment, said water-swellable polymer is selected from the group consisting of starch, albumin, alginate (sodium alginate), agar, amylose, cellulose, chicle gum, gelatin, gellan gum, glucomannan, Arabic gum, guar gum, gum Arabic, karaya gum, locust bean gum, mastic gum, spruce gum, tara gum, tragacanth gum, xanthan gum, cellulose acetate, cellulose triacetate, cellulose acetate ethyl carbamate, cellulose acetate phthalate, cellulose acetate methyl carbamate, cellulose acetate succinate, cellulose acetate dimethyl aminoacetate, cellulose acetate ethyl carbonate, cellulose acetate chloroacetate, cellulose acetate ethyl oxalate, cellulose acetate methyl sulfonate, cellulose acetate butyl sulfonate, cellulose acetate propionate, cellulose acetate diethyl aminoacetate, cellulose acetate octate, cellulose acetate laurate, cellulose acetate p-toluol sulfonate, cellulose acetate butyrate, sodium acrylate, potassium acrylate, alkyl acrylate and chemical equivalents thereof, and mixtures thereof. It is within the scope of the present invention to use any combination of these particular water expandable materials which are capable of rendering the explosive material insensitive to initiation by fragmenting said explosive material into small particles, said small particles having a diameter below the critical diameter for detonation sensitivity for said explosive material. Thus, in a particular embodiment, the water expandable material comprises a plurality of water expandable materials.

The water expandable material, if desired, can be stored in a capsule, and the capsule can be placed, preferably, within the other components of the explosive formulation. Thus, in a particular embodiment, the above method further comprises the step of storing the water expandable material in a capsule, the capsule being contacted with the explosive materials. The particulars of the capsule have been previously disclosed when referring to the different embodiments of the explosive apparatus shown in the accompanying figures. The capsule material may include any material configured to permit an interaction between the water expandable material and the explosive material in the explosive device. In a particular embodiment, the capsule is biodegradable and comprises a biodegradable material, such as a biodegradable paper or polymer material.

As mentioned above, the above method is designed to enable water expandable materials to mechanically remediate a quantity of an explosive material. So, the water expandable material is disposed in sufficient proximity or contact to the explosive material so that when the explosive device is exposed to water, the water expandable material in the quantity thereof is capable of rendering the explosive material insensitive to initiation by any means by virtue of the fact that the explosive material has been fractured into small particles and is thus below the critical diameter sensitivity threshold for the explosive material, whereby if the explosive device is installed at a detonation site and fails to detonate as intended, when the quantity of water expandable material is activated, the water expandable material in the quantity thereof deactivates the explosive device by fracturing the quantity of explosive material in situ at the detonation site.

Yet another method of chemoremediating explosives involves installing an explosive charge in a detonation site, such as a borehole, and then positioning chemical reagents around the explosive charge by depositing chemical reagents directly on the explosive charge and the detonation site. Similarly, chemical reagents can be first deposited at the detonation site followed by placing the explosive charge directly in the chemical reagents.

In another aspect, the invention provides a self-degradable, shaped explosive formulation, substantially free of water-soluble oxidizing salts, hereinafter self-degradable formulation of the invention, comprising:

at least one explosive material, and between 0.2% and 1% by weight with respect to the total weight of the explosive formulation of a water expandable material.

As it is used herein, the expression "substantially free of water-soluble oxidizing salts" means that the self-degradable formulation of the invention lacks, or contains an amount equal to or less than 1% by weight with respect to the total weight of the explosive formulation of the invention, of one or more completely or partially water-soluble oxidizing salts used in the production of explosive formulations, for example, ammonium nitrates, chlorates and perchlorates, or of alkaline or alkaline-earth metals, and mixtures thereof. In a particular embodiment, the self-degradable formulation of the invention contains an amount equal to or less than 0.5% by weight with respect to the total weight of the explosive formulation of the invention, of said oxidizing salts; preferably, the self-degradable formulation of the invention lacks said completely or partially water-soluble oxidizing salts used in the production of explosive formulations.

The term "shaped" in the sense used in the present description means that the self-degradable formulation of the invention has a determined spatial or three-dimensional configuration, for example, cylindrical, etc., in which its components are bound by cohesive and/or adhesive forces.

Likewise, as it is used herein, the term "self-degradable" applied to an explosive formulation means that said explosive formulation is converted into a non-explosive formulation or into a formulation that is less explosive by itself due to the action of the water-swellable polymer.

The explosive material can be a remediable explosive, for example a chemoremediable explosive and/or a mechanically remediable explosive. In a particular embodiment, said explosive material is a molecular explosive. As used herein, a "molecular explosive" relates to an explosive in which the essential elements (fuel and oxidizer) are contained within the same molecule (U.S. Pat. No. 4,718,953). Illustrative, non-limiting examples of molecular explosives which can be present in the self-degradable formulation of the invention include halocarbons, hydrocarbons, organic nitroaromatics, organic nitramines, and organic nitric esters explosives. In a particular embodiment, said explosive material is selected from the group consisting of trinitrotoluene, hexanitrostilbene, hexanitroazobenzene, diaminotrinitrobenzene, triaminotrinitrobenzene, cyclotri-methylene trinitramine, cyclotetramethylene trinitramine, nitroguanidine, 2,4,6-trinitrophenylmethylnitramine, hexanitrohexaazaisowurtzitane, pentaerythritol tetranitrate, nitroglycerine, nitrocellulose, ethylene glycol dinitrate, halocarbons, hydrocarbons and mixtures thereof.

In a particular embodiment, the self-degradable formulation of the invention comprises a single molecular explosive. In another particular embodiment, the self-degradable formulation of the invention comprises two or more molecular explosives. Illustrative, non-limiting examples of mixtures of molecular explosives include Pentolite (a mixture of TNT and PETN), Composition B (a mixture of TNT and RDX).

In addition to the explosive material (e.g., a molecular explosive), the self-degradable formulation of the invention comprises a water expandable material. The term "water expandable material" has been previously defined. In a particular embodiment, said water expandable material is a water-swellable polymer.

As it is used herein, the expression "water-swellable polymer" relates to a water-soluble or water-insoluble polymer which, in contact with water, is capable of absorbing one or more times its own weight in water, i.e., increasing its initial weight (Wo) until reaching a final weight (Wf) greater than its initial weight (Wo), or is capable of absorbing water and increasing its initial volume (Vo) until reaching a final volume (Vf) greater than its initial volume (Vo). By illustrative, Wf or Vf can be, at least, 1.1 times Wo or Vf, respectively, typically at least 1.2, 1.3, 1.4, 1.5, 1.6, 1.7, 1.8, 1.9, 2, 5, 10, 15, 25, 50 or 100 times Wo or Vo, respectively, or even more. The affinity of said polymer for water and its capacity of absorbing it and increasing its weight and/or volume have a mechanical effect on the self-degradable (shaped) formulation of the invention since increasing the volume of the water-swellable polymer causes a breakdown or rupture of the self-degradable formulation of the invention, which is thus insensitive to the detonator. Therefore, said water-swellable polymer acts as a swelling agent and is responsible for the physical-mechanical decomposition of the self-degradable formulation of the invention. Generally, the actual moisture of the soil or of the subsoil as well as the inclemency of the weather (e.g., rain, snow, etc.), provide with the sufficient amount of water so that the water-swellable polymer increases its volume and exerts its swelling action causing the physical-mechanical breakdown or rupture of the self-degradable formulation of the invention and, consequently, its degradation; nevertheless, if necessary, a reservoir or a source of water could be included in the self-degradable formulation of the invention or in the explosive device containing the self-degradable formulation of the invention so that, once a time has passed without the explosive charge being detonated, the physical-mechanical breakdown or rupture of the self-degradable formulation of the invention takes place. Alternatively, water could be provided by means of irrigation or inundation of the area in which the undetonated explosive devices containing the self-degradable formulation of the invention are located so that their degradation takes place.

The correct initiation of explosives requires the initiator element or detonator to be in direct contact with the explosive to be initiated. If the explosive to be initiated is broken down, or is not firmly in contact with the detonator, it will be not initiated. The broken down explosive with a high content in water, absorbed by the water expandable material, e.g., the water-swellable polymer, is equally desensitized to stimuli by impact or friction, preventing its detonation.

The water expandable material is in direct and close contact with the self-degradable formulation of the invention forming an assembly; likewise, if desired, the same or another water expandable material could be included as a barrier agent between water and the self-degradable formulation of the invention which, as has been previously mentioned, will always contain a water expandable material.

The water expandable material, if desired, can be stored in a capsule, and the capsule can be placed, preferably, within the other component or components of the explosive formulation (e.g., explosive material). The particulars of the capsule have been previously disclosed when referring to the different embodiments of the explosive apparatus shown in the accompanying figures. The capsule material may include any material configured to permit an interaction between the water expandable material and the explosive material in the explosive device. In a particular embodiment, the capsule is biodegradable and comprises a biodegradable material, such as a biodegradable paper or polymer material. The capsule containing the water expandable material is configured to become permeable to water after a predetermined period of time, such as after a period of about six months to about thirty-six months. Following exposure to water, the water expandable material expands thereby breaking the explosive material into a multiplicity of small fragments, each fragment being below the critical diameter required for detonation sensitivity. In other embodiments, chemical reagents are combined with the water expandable material such that the explosive material is both fragmented and rendered harmless.

The water expandable material can be present in the self-degradable formulation of the invention in an amount comprised between 0.2% and 1.0% by weight, typically, 0.2%, 0.3%, 0.4%, 0.5%, 0.6%, 0.7%, 0.8%, 0.9%, or 1.0%, preferably, between 0.2% and 0.5% by weight with respect to the total weight of the self-degradable formulation of the invention.

Illustrative, non-limiting examples of water expandable materials which can be present in the self-degradable formulation of the invention include water-swellable polymers, such as natural or synthetic gums; polymers, preferably hydrophilic polymers known for their ability to absorb one or more times their own weight in water; etc. In a particular embodiment, said water-swellable polymer is a polysaccharide or a derivative thereof, a polymer, such as a homopolymers or a copolymer consisting of polymethacrylates, polyacrylates, poly(acrylic acid), polyacrylamide, polyvinylpyrrolidone, polyvinyl alcohol, polylactic acid, polyalkylene oxides, etc., and mixtures thereof. In a particular embodiment, said water-swellable polymer is selected from the group consisting of starch, albumin, alginate (sodium alginate), agar, amylose, cellulose, chicle gum, gelatin, gellan gum, glucomannan, Arabic gum, guar gum, gum Arabic, karaya gum, locust bean gum, mastic gum, spruce gum, tara gum, tragacanth gum, xanthan gum, cellulose acetate, cellulose triacetate, cellulose acetate ethyl carbamate, cellulose acetate phthalate, cellulose acetate methyl carbamate, cellulose acetate succinate, cellulose acetate dimethyl aminoacetate, cellulose acetate ethyl carbonate, cellulose acetate chloroacetate, cellulose acetate ethyl oxalate, cellulose acetate methyl sulfonate, cellulose acetate butyl sulfonate, cellulose acetate propionate, cellulose acetate diethyl aminoacetate, cellulose acetate octate, cellulose acetate laurate, cellulose acetate p-toluol sulfonate, cellulose acetate butyrate, sodium acrylate, potassium acrylate, alkyl acrylate and chemical equivalents thereof, and mixtures thereof. It is within the scope of the present invention to use any combination of these particular water expandable materials which are capable of rendering the explosive material insensitive to initiation by fragmenting said explosive material into small particles, said small particles having a diameter below the critical diameter for detonation sensitivity for said explosive material. Thus, in a particular embodiment, the water expandable material comprises a plurality of water expandable materials.

In another particular embodiment, the self-degradable formulation of the invention comprises a water expandable material selected from the group consisting of gum arabic, guar gum, gum karaya, gum tragacanth and xanthan gum, preferably, xanthan gum or gum karaya. Examples 14-18 clearly show the capacity of said polymers to break down (decompose), in aqueous medium, cylinder-shaped pentolite (PETN/TNT) formulations; once broken down, said formulations lose their detonation capacity.

In another particular embodiment, the self-degradable formulation of the invention comprises a single water expandable material. In another particular embodiment, the self-degradable formulation of the invention comprises two or more water expandable materials.

In addition to the molecular explosive and the water expandable material, the self-degradable formulation of the invention can contain other components, e.g., a wax, the purpose of which is to reduce the viscosity of the mixture during the processing and manufacture thereof; in a particular embodiment said wax is a paraffin wax. Said component (wax) generally has no effect on the degradability characteristics of the self-degradable formulation of the invention. The wax can be present in the self-degradable formulation of the invention in an amount comprised between more than 0% and 2%, preferably, between 0.5% and 1% by weight with respect to the total weight of the self-degradable formulation of the invention. As used herein, the expression "more than 0%" or similar means that the component is present in the formulation although in a very small quantity, e.g., 0.0001%, 0.001%, 0.01%, or 0.1%.

As it has been previously mentioned, the physical-mechanical breakdown or rupture of the self-degradable formulation of the invention causes its insensitivity to a detonator; however, although the risk of accidental detonation is eliminated, the explosive material, such as the molecular explosive, contained in said self-degradable formulation of the invention (organic nitroaromatics, nitroesters and/or nitramines) maintains its explosive characteristics and represents a potential source of environmental pollution; it would therefore be advantageous for the self-degradable formulation of the invention to have a system that allows converting said compounds into safe compounds, i.e., inert or non-explosive compounds.

Therefore, in a particular embodiment, in addition to the explosive material (e.g., molecular explosive) and the water expandable material (e.g., water-swellable polymer), the self-degradable formulation of the invention comprises a material capable of converting said explosive material into a safe compound (i.e., inert or non-explosive compound). Virtually any biological and non-biological material capable of converting said explosive material into a safe compound can be incorporated in the self-degradable formulation of the invention to achieve the purpose that is sought. Said material capable of converting the explosive material into a safe compound can physically be in direct and close contact with the explosive material and/or with the water expandable material forming an assembly; alternatively, said material capable of converting the explosive material into a safe compound could be separated from the explosive material and/or from the water expandable material by means of a type of barrier which allows them to be in contact at the end of a determined time if the explosive charge containing the self-degradable formulation of the invention has not detonated.

Illustrative, non-limiting examples of materials capable of converting an explosive material into a safe compound which can be incorporated in the self-degradable formulation of the invention to achieve the purpose that is sought include chemical reagents, for example reducing agents of nitro, nitrate or nitramino groups; enzymes, for example, reductases; or microorganisms capable of degrading said organic nitroaromatics (nitroderivatives), nitroesters or nitramines.

Therefore, if desired, in a particular embodiment, in addition to the explosive material (e.g., molecular explosive) and the water expandable material (e.g., water-swellable polymer), the self-degradable formulation of the invention comprises a reducing agent of the nitro group, a reducing agent of the nitrate group, a reducing agent of the nitramino group, or mixtures thereof. By means of said reducing agents, the nitro, nitrate or nitramino groups present in the explosive materials are converted into other functional groups which do not have explosive characteristics. In this particular embodiment, in addition to the physical-mechanical breakdown or rupture of the self-degradable formulation of the invention causing its desensitization and preventing its detonation, caused by the presence of the water expandable material, a chemical degradation of the explosive material occurs, it thereby loses its explosive characteristics. Thus, the physical-mechanical breakdown converts an explosive sensitive to the initiation into an explosive insensitive to the initiation, whereas chemical decomposition converts the explosive insensitive to the initiation into another non-explosive product.

Illustrative, non-limiting examples of reducing agents of nitro, nitrate or nitramino groups which can optionally be present in the self-degradable formulation of the invention include metals (e.g., iron, tin, zinc, etc.), iron(II) salts (e.g., ferrous sulfate, etc.), tin(II) salts (e.g., stannous chloride, etc.), titanium(III) salts (e.g., titanium(III) chloride, titanium (III) sulfate, etc.), hydroxides (e.g., ferrous hydroxide, etc.), thiosulfates (e.g., sodium thiosulfate, etc.), sulfides (e.g., sodium sulfide, ammonium sulfide, sodium polysulfide, ammonium polysulfide, etc.), borane (compound of boron and hydrogen), borane derivatives or precursors (e.g., diborane ($B_2H_6$), borane-tetrahydrofuran complexes ($BH_3$.THF), borane-dimethyl sulfide complexes ($BH_3.Me_2S$), as well as compounds generating borane or diborane in the reaction medium, such as, for example, $NaBH_4/I_2$, $NaBH_4/BF_3(OEt)_2$, $NaBH_4$/HCl, etc.), hydrides (e.g., lithium aluminium hydride, etc.), etc. Said reducing agents are capable of reducing nitro, nitrate and nitramino groups although the degradation mechanisms are different between said nitro, nitrate and nitramino groups.

The reduction of the nitro group can be carried out in acidic, basic or neutral medium. Therefore, in a particular embodiment, in addition to said reducing agent, the self-degradable formulation of the invention comprises a reagent providing, in contact with water, an acidic, basic or neutral medium, for example, an inorganic acid (e.g., hydrochloric acid, etc.), an organic acid (e.g., salicylic acid, etc.), an inorganic base (e.g., sodium hydroxide, etc.), or a salt (e.g., ammonium chloride, etc).

Generally, the nitro group (—$NO_2$) present in explosive materials containing nitro groups (nitroderivatives), e.g., TNT, hexanitrostilbene, hexanitroazobenzene, diamino-trinitrobenzene, triaminotrinitrobenzene, etc., is converted into a nitroso group (—NO), giving rise to a nitroso-derivative, due to the action of a reducing agent of the nitro group; said nitroso group can in turn be reduced to an amino group (—$NH_2$), giving rise to an aminoderivative, or, it can alternatively undergo dimerization giving rise to an azo compound (—N═N—) or a hydrazo compound (—NH—NH—) before its conversion into an amino group.

By way of a non-limiting illustration, the reduction of the nitroderivatives to other reduced compounds (nitroso-derivative, azo compound, hydrazo compound, aminoderivative) can be carried out by means of different combinations of reducing agents/medium, for example, by means of a metal (e.g., iron, tin or zinc) and an inorganic acid; zinc in the presence of an aqueous solution of ammonium chloride; zinc in the presence of an aqueous solution of sodium hydroxide; zinc in the presence of an aqueous solution of an organic acid (e.g., salicylic acid); ferrous sulfate; ferrous hydroxide; stannous chloride in the presence of an inorganic acid (e.g., HCl); titanium trichloride ($TiCl_3$); titanium(III) sulfate ($Ti_2(SO_4)_3$); sodium thiosulfate, sulfide or sodium or ammonium polysulfide; or diborane.

Likewise, the nitrate ester group (—$ONO_2$) present in explosive materials containing said esters or nitroesters (e.g., nitroglycerine, nitrocellulose, PETN, EGDN, etc.) in the presence of a reducing agent gives rise to an alcohol (R—OH) and to the nitrite ion ($NO_2^-$) which is finally reduced to ammonia ($NH_3$).

In a particular embodiment, the self-degradable formulation of the invention comprises a reducing agent selected from the group consisting of iron metal ($Fe^0$), ferrous sulfate, iron metal ($Fe^0$) and sodium hydroxide, zinc metal ($Zn^0$) and ammonium chloride, zinc metal ($Zn^0$) and salicylic acid, and combinations thereof.

Said reducing agent can be present in the self-degradable formulation of the invention in an amount comprised between 0% and 30% by weight with respect to the total weight of the self-degradable formulation of the invention. In a particular embodiment, the self-degradable formulation of the invention does not contain said reducing agent. In another particular embodiment, the self-degradable formulation of the invention comprises a reducing agent of nitro, nitrate or nitramino groups, in an amount of up to 30% by weight (i.e., in "X" percentage by weight wherein $0<X\leq30$) with respect to the total weight of the self-degradable formulation of the invention, typically between 0.5% and 20%, advantageously between 1% and 10%, preferably, between 2% and 5% by weight with respect to the total weight of the self-degradable formulation of the invention.

The self-degradable formulation of the invention can contain between 0% and 5% by weight with respect to the total weight of the self-degradable formulation of the invention of a reagent providing, in contact with water, an acidic, basic or neutral medium. In a particular embodiment, the self-degradable formulation of the invention does not contain said reagent providing, in contact with water, an acidic, basic or neutral medium, regardless of whether or not the self-degradable formulation of the invention includes a reducing agent of nitro, nitrate or nitramino groups. In another particular embodiment, in addition to the reducing agent, the self-degradable formulation of the invention comprises a reagent providing, in contact with water, an acidic, basic or neutral medium, in an amount equal to or less than 15% by weight (i.e., in "Y" percentage by weight wherein $0<Y\leq15$), preferably between 1% and 10% by weight, with respect to the total weight of the self-degradable formulation of the invention.

In the event that the self-degradable formulation of the invention contains, in addition to the explosive material (e.g., molecular explosive) and the water expandable material (e.g., water-swellable polymer), a reducing agent and optionally a reagent providing, in contact with water, an acidic, basic or neutral medium, said reducing agent and, where appropriate, said reagent providing, in contact with water, an acidic, basic or neutral medium, can be in close and direct contact with the explosive material and/or with the water expandable material. Alternatively, said reducing agent and, where appropriate, reagent providing, in contact with water, an acidic, basic or neutral medium, can be separated from the explosive material and/or the water expandable material by a type of barrier which allows them to make contact at the end of a determined time if the explosive charge containing the self-degradable formulation of the invention has not detonated.

Alternatively, in another particular embodiment, in addition to the explosive material (e.g., molecular explosive) and the water expandable material (e.g., water-swellable polymer), the self-degradable formulation of the invention can contain, if desired, an enzyme capable of degrading said explosive material. Illustrative, non-limiting examples of enzymes capable of degrading explosive materials include several redox enzymes, such as ferredoxin NADP oxidoreductase, glutathione reductase, xanthine oxidase and oxyrase, enzymes capable of converting TNT into 4-HADNT, the PETN reductase capable of degrading PETN (WO 97/03201) and TNT (WO 99/32636). Said enzyme can be present in the self-degradable formulation of the invention in an amount comprised between 0% and 10% by weight with respect to the total weight of the self-degradable formulation of the invention. In a particular embodiment, the self-degradable formulation of the invention does not contain said enzyme. In another particular embodiment, the self-degradable formulation of the invention comprises an enzyme capable of degrading said explosive material in an amount of up to 10% by weight (i.e., in "Z" percentage by weight wherein $0<Z\leq10$), with respect to the total weight of the self-degradable formulation of the invention, typically between 1% and 5% by weight with respect to the total weight of the self-degradable formulation of the invention.

In the event that the self-degradable formulation of the invention contains, in addition to the explosive material (e.g., molecular explosive) and the water expandable material (e.g., water-swellable polymer), an enzyme capable of degrading said explosive material, said enzyme can be in close and direct contact with the explosive material and/or with the water expandable material. Alternatively, said enzyme can be separated from the explosive material and/or from the water expandable material by a type of barrier which allows them to make contact at the end of a determined time if the explosive charge containing the self-degradable formulation of the invention has not detonated.

Likewise, in another particular embodiment, in addition to the explosive material (e.g., molecular explosive) and the water expandable material (e.g., water-swellable polymer), the self-degradable formulation of the invention can contain, if desired, a microorganism capable of degrading said explosive material. Illustrative, non-limiting examples of microorganisms capable of degrading explosive materials include *Pseudomonas* spp., *Escherichia* spp., *Morganella* spp., *Rhodococcus* spp., *Comamonas* spp., *Klebsiella* spp., etc. (see, for example, U.S. Pat. No. 7,240,618, ES 2046140, ES 2083327, ES 2064287 and ES 2125193). In this case, the arrangement of the microorganisms and the nutrients necessary for their maintenance can adopt any suitable arrangement, such as the arrangement described in U.S. Pat. No. 7,240,618.

Due to the fact that the self-degradable formulation of the invention can contain, if desired, in addition to the explosive material (e.g., molecular explosive) and the water expandable material (e.g., water-swellable polymer), several components, such as a reducing agent of nitro, nitrate or nitramino groups, and optionally a reagent providing, in contact with water, an acidic, basic or neutral medium, or an enzyme or a microorganism capable of degrading the explosive material, the amount of explosive material present in the self-degradable formulation of the invention can vary within a wide range, typically comprised between approximately 42.0% and approximately 99.8% by weight with respect to the total weight of the self-degradable formulation of the invention, for example, between approximately 52.0% and 99.8%, or between approximately 67.0% and 99.8%, or between approximately 97.0 and 99.8%, or between approximately 99.0% and 99.8% by weight with respect to the total weight of the self-degradable formulation of the invention. Thus, in the simplest embodiment of the invention, the self-degradable formulation of the invention formed substantially by an explosive material (e.g., molecular explosive) and a water expandable material (e.g., water-swellable polymer) contains between 99.0% and 99.8% by weight, preferably between 99.0% and 99.5% by weight of explosive material with respect to the total weight of the self-degradable formulation of the invention. In another particular embodiment, in addition to an explosive material and a water expandable material, the self-degradable formulation of the invention comprises a wax (e.g., a paraffin wax) and contains between 97.0% and 99.8% by weight of explosive material with respect to the total weight of the self-degradable formulation of the invention. In another particular embodiment, in addition to a explosive material and a water expandable material, the self-degradable formulation of the invention comprises a wax (e.g., a paraffin wax) and a reducing agent of nitro, nitrate or nitramino groups and contains between 67.0% and 99.8% by weight of explosive material with respect to the total weight of the self-degradable formulation of the invention. In another particular embodiment, in addition to an explosive material and a water expandable material, the self-degradable formulation of the invention comprises a wax (e.g., a paraffin wax), a reducing agent of nitro, nitrate or nitramino groups and a reagent providing, in contact with water, an acidic, basic or neutral medium, and contains between 52.0% and 99.8% by weight of explosive material with respect to the total weight of the self-degradable formulation of the invention. The person skilled in the art will understand that the amount of explosive material in the self-degradable formulation of the invention will depend on the presence of other components in the self-degradable formulation of the invention (e.g., paraffin wax, reducing agent of nitro, nitrate or nitramino groups, reagent providing, in contact with water, an acidic, basic or neutral medium, enzyme capable of degrading the explosive material and/or microorganism capable of degrading the explosive material); said amount can be calculated in a conventional manner by the person skilled in the art.

The self-degradable formulation of the invention can be obtained by conventional methods well-known by the skilled person in the art. Generally, said methods comprise mixing the appropriate amounts of the different components under suitable conditions for obtaining the self-degradable formulation of the invention. In a particular embodiment, the process for the manufacture of the self-degradable formulation of the invention comprises melting at least one of its components, e.g., the explosive material, and, subsequently shaping the formulation in the desired shape. In another particular embodiment, the process for the manufacture of the self-degradable formulation of the invention comprises mixing the components of the formulation together, optionally in the presence of a binder, and, subsequently, shaping the formulation. The formulation can be shaped by conventional methods, e.g., by extrusion, pressing, etc. A binder is an ingredient used to bind together two or more other materials in mixtures; its two principal properties are adhesion and cohesion. Suitable binders for use in said process are known by the skilled person in the art; preferably, said binders will be inert, i.e., will not substantially react with the explosive material or with the water expandable material but it will bind together said materials in the mixture by adhesion and/or cohesion.

The other components (e.g., waxes, reducing agents of nitro, nitrate or nitramino groups; reagents providing, in contact with water, an acidic, basic or neutral medium; enzymes; etc.), if present, will be added to the mixture by conventional means and methods. If the self-degradable formulation of the invention contains an enzyme capable of degrading the explosive material, the enzyme can be incorporated by conventional methods known by the skilled person in the art (e.g., the methods disclosed by WO 97/03201, WO 99/32636 or WO2009/094716). Alternatively, if the self-degradable formulation of the invention contains a microorganism capable of degrading the explosive material, the microorganism can be incorporated by conventional methods known by the skilled person in the art (see, for example, U.S. Pat. No. 7,240,618, ES 2046140, ES 2083327, ES 2064287 or ES 2125193). In this case, the arrangement of the microorganisms and the nutrients necessary for their maintenance can adopt any suitable arrangement, such as the arrangement described in U.S. Pat. No. 7,240,618.

The self-degradable formulation of the invention can be included in any suitable explosive device designed in accordance with the teachings of the present invention and exemplified in some embodiments of the apparatus and devices previously disclosed and provided by the instant invention or in any other suitable explosive device.

Thus, in another aspect, the invention relates to a self-degradable explosive device comprising a shell having an inner lumen (empty space) therein, a self-degradable formulation of the invention deposited inside said shell, and means to allow water or moisture to come into contact with said explosive formulation.

In a particular embodiment, said means to allow water or moisture to come into contact with said explosive formulation are one or more holes, preferably a plurality of holes, allowing water or moisture to enter inside the shell so that the water expandable material starts the physical-mechanical breakdown or decomposition of the explosive formulation of the invention. In another particular embodiment, all or some of said holes are covered, closed or sealed with a water-soluble or water-porous material allowing water or moisture to enter so that the water expandable material of the explosive formulation starts the physical-mechanical breakdown or decomposition of the explosive formulation of the invention.

The shell may be manufactured with any suitable material, for example, a material configured to permit an interaction between water or moisture and the self-degradable formulation of the invention. In a particular embodiment, the shell is degradable and comprises, or consists of, a degradable material, such as a degradable paper or polymer material, including a plastic material, or incorporates a degradable additive. The skilled person in the art can select a suitable degradable material to be used in the manufacture of the shell. Illustrative examples thereof have been previously disclosed thorough the description. In a particular embodiment, the shell contains one or more holes, preferably a plurality of holes, in order to allow water or moisture to enter inside the shell. In another particular embodiment, all or some of said holes of the shell are covered, closed or sealed with a water-soluble or water-porous material allowing water or moisture to enter into the shell.

Although different embodiments of the self-degradable explosive device provided by the invention can be manufactured, in a particular embodiment, the invention relates to a self-degradable explosive device wherein the shell material is degradable or comprises a degradable material, the explosive material comprises pentolite and the water expandable material is a gum; in a preferred embodiment, a self-degradable explosive device is provided wherein the shell material comprises a degradable plastic or a plastic material having a degradable additive, the explosive material comprises pentolite and the water expandable material is a guar gum.

Illustrative, non-limiting examples of said explosive devices include explosive devices for seismic surveys, military explosive devices (e.g., anti-tank mines, anti-personnel mines, grenades, bombs, etc.).

FIGS. 1 and 2 show illustrative, non-limiting examples of the explosive devices provided by this invention. As can be seen in said FIGS. 1 and 2, said explosive devices comprise a shell (2) for housing the self-degradable formulation of the invention (1) and in which an initiation system or detonator (4) is housed. The shell (2) of the explosive device shown in FIG. 1 is provided with side holes (3) allowing water or moisture to enter inside the self-degradable formulation so that the water expandable material starts the physical-mechanical breakdown or decomposition of the explosive formulation of the invention in the event of an initiation failure. In FIG. 2, the holes (3) of the shell (2) housing the self-degradable formulation of the invention (1) are sealed with a water-porous or water-soluble material (3'), equally allowing water or moisture to enter inside the shell (2) so that the water expandable material of the explosive formulation starts the physical-mechanical breakdown or decomposition of the explosive formulation of the invention in the event of an initiation failure.

Experiments were conducted to study the process of remediating explosive materials according to the teachings of the present invention. The results of several of these experiments are set forth below. Thus, the following examples illustrate the invention and must not be considered as limiting the scope thereof.

Example 1

Three SOB booster samples containing 7.5 g of Pentolite were placed in three alkaline solutions to determine an efficacious pH level for a desired chemoremediative reaction. The Pentolite SOB booster samples were placed in the solutions and left undisturbed for ten days, in a locked magazine. The SOB boosters comprised plastic bodies having an open end positioned near the bottom of the booster. An upper, narrow end of the SOB booster comprised a plastic sleeve designed to fit onto a detonator.

The three alkaline solutions were as follows: 1.71% $Ca(OH)_2$ (300 g) in water resulting in a pH=11.34; 4.67% KOH (300 g) in water resulting in a pH=13-14; and 6.84% NaOH (300 g) in water resulting in a pH=13. Samples were monitored until reactions were deemed complete. Following completion, sample residues were dried and tested on a standard BAM impact hammer, where the material showed impact sensitivity similar to that of PETN. Table 1 below indicates the chemoremediative analysis of these samples after each designated time interval.

TABLE 1

Chemoremediation of Pentolite

| Days | KOH | NaOH | Ca(OH)2 |
|---|---|---|---|
| 0 | 7.5 | 7.5 | 7.5 |
| 10 | 7.7 | 7.6 | 7.5 |
| 18 | 6.6 | 7.1 | 7.7 |
| 31 | 5.8 | 6.6 | 7.6 |
| 59 | 4.0 | 5.4 | 7.7 |
| 98 | 2.14 | 4.2 | 7.7 |

Both NaOH and KOH showed good reaction with Pentolite, while $Ca(OH)_2$ showed no detectable remediation. The KOH solution appeared to react better than the NaOH solution, which may have been a result of the increased concentration of the KOH solution. After 98 days, the Pentolite in the KOH solution was completely dissolved/consumed.

Example 2

Alkaline hydrolysis of Pentolite with and without a catalyst was performed. Impact analysis showed that NaOH and KOH will hydrolyze TNT without the use of a catalyst but will not change PETN after six months of being in contact with an alkaline solution at pH=13. A catalyst (stannous chloride) was added to the alkaline solution rendering the end product no longer impact sensitive. Stannous chloride may be dissolved in water but is preferably dissolved in a dipolar aprotic solvent with a dielectric constant ($\in$) greater than 6, such as THF, Methylpyrrolidone or DMF. Solvents such as methanol ($\in$=33.1) and ethanol ($\in$=23.8) may also be used. A mixture of dipolar aprotic solvent and water may also be used. One to three parts of stannous chloride was dissolved in an adequate amount of solvent, solvent mixture or water. Subsequently, 3 to 12 parts of sodium hydroxide solution to one part of stannous chloride were added to make the remediation solution.

Example 3

Alkaline hydrolysis of Pentolite with and without a catalyst was performed. Impact analysis showed that NaOH and KOH will hydrolyze TNT without the use of a catalyst but will not change PETN after six months of being in contact with an alkaline solution at pH=13. A catalyst (mixture of ferrous chloride and stannous chloride) was added to the alkaline solution rendering the end product no longer impact sensitive. Remediation solution contained 3-15% $FeCl_2.4H_2O$, 5-25% HCl, and 0.5%-5% $SnCl_2$ dissolved in water.

Example 4

PETN has been found to be particularly stable in a strong alkaline medium and would thus resist hydrolysis or hydrolyze very slowly. A variety of compounds such as $SnCl_2$, $FeCl_2$ and $FeSO_4$ in combination with acid (HCl or $H_2SO_4$) or base solutions (NaOH or KOH) were found to reduce PETN to a non-explosive compound.

More particularly, the reduction of PETN via the $SnCl_2$ method was found to be very effective and very fast. Preferred solvent mixtures for the $SnCl_2$ reducing agent include water and DMF (dimethyl formamide) and water and methylpyrrolidone. However, success was shown using a variety of other aprotic dipolar solvents which prevent the oxidation of the catalyst.

Extensive testing showed that the preparation of the stannous chloride, sodium hydroxide and dimethyl formamide reducing solution is critical to ensure its efficacy. For example, if the stannous chloride comes into contact with sodium hydroxide under the wrong conditions, the tin will be oxidized or hydrolyzed to a solid tin material. Therefore the solution will not reduce PETN to an inert material. In order to protect the stannous ion from being oxidized, the stannous chloride must first be dissolved in the DMF/water or methylpyrrolidone/water. Then solid hydroxide is dissolved in water. The hydroxide solution is rapidly added to the stannous chloride solution. If the hydroxide solution or hydroxide is added slowly to the stannous chloride solution, then oxidation of the tin will occur. High concentrations of DMF or methylpyrrolidone will protect the tin ions from oxidation. Since methylpyrrolidone has a higher pH than DMF it proves to be more compatible with the hydroxide solution. A lower concentration of methylpyrrolidone may be used in the remediation solution compared to DMF. In one sample the concentration of methylpyrrolidone was only 10% of the total mixture.

In one series of experiments, nine different remediation solutions were set up. The ratio of stannous chloride and sodium hydroxide was changed in each solution to determine the limits of this method. The table below gives the concentration of each compound in the solution. Each of these samples turned dark instantly when Pentolite was added to the solution. This indicated that the TNT was hydrolyzed upon contact with the solution. Impact sensitivity tests of certain of the dried precipitates from these tests have shown the material insensitive to a 10 kg weight at 0.6 meter (BAM Impact Tests Apparatus). HPLC analysis of the solute could not detect PETN at ppm levels, showing the PETN was also totally destroyed.

| | Concentration (%) | | | | |
|---|---|---|---|---|---|
| Sample | $SnCl_2$ | NaOH | $H_2O$ | DMF | Pentolite |
| 1 | 0.4 | 1.6 | 17.2 | 80.4 | 0.4 |
| 2 | 1.1 | 7.2 | 15.8 | 75.5 | 0.4 |
| 3 | 9.5 | 6.0 | 43.5 | 40.9 | 0.06 |
| 4 | 9.8 | 19.8 | 47.6 | 22.7 | 0.07 |
| 5 | 4.9 | 21.4 | 33.4 | 40.2 | 0.1 |
| 6 | 0.4 | 1.0 | 17.7 | 80.4 | 0.5 |
| 7 | 0.4 | 0.7 | 18.3 | 80.1 | 0.5 |
| 8 | 1.0 | 6.7 | 20.5 | 71.3 | 0.4 |
| 9 | 0.4 | 1.0 | 19.0 | 78.6 | 1.0 |

Dark solids were filtered from samples 3 and 4 prior to adding Pentolite. Both samples showed no signs of degradation after 30 days. The impact analysis of these samples was the same as dried PETN (100% reaction when a 1 kg weight was dropped from 40 cm). Sample 7 partially reacted when a 1 kg weight was dropped from 60 cm. The remaining samples did not react when a 10 kg weight was dropped from 60 cm. The HPLC analysis for these samples also confirmed the PETN was degraded to an inert compound.

Prior to testing these solutions with pentolite some of the solutions were first tested with PETN, RDX and HMX. The results from these tests are listed in the table below.

| Sample | $SnCl_2$ | NaOH | KOH | $H_2O$ | DMF | PETN | RDX | HMX |
|---|---|---|---|---|---|---|---|---|
| 1 | 9.5 | 6.0 | | 43.5 | 40.9 | .06 | — | — |
| 2 | 0.95 | 4.16 | | 79.30 | 15.19 | 0.40 | — | — |
| 3 | 0.95 | 3.69 | | 77.41 | 17.59 | 0.35 | — | — |
| 4 | 0.4 | 1.0 | | 19.0 | 78.6 | 1.0 | — | — |
| 5 | 1.1 | 5.1 | | 19.0 | 74.3 | — | 0.5 | — |
| 6 | 0.9 | 4.0 | | 19.1 | 75.6 | — | — | 0.4 |
| 7 | 0.4 | — | 1.4 | 17.1 | 80.6 | 0.5 | — | — |
| 8 | 0.4 | — | 0.6 | 16.4 | 82.1 | 0.5 | — | — |
| 9 | 0.4 | — | 1.4 | 16.9 | 80.8 | 0.5 | — | — |

There was no reaction when a 10 kg weight was dropped from 60 cm on all 6 samples with sodium hydroxide. With samples 7, 8 and 9 the sodium hydroxide was replaced by potassium hydroxide. There was no reaction for samples 7 and 9 when a 10 kg weight was dropped from 60 cm. The impact results for sample 8 were the same as dried PETN.

Example 5

Various methods and chemical reagents were explored to degrade Pentolite, specifically to degrade the PETN component. Tested methods and chemical reagents include: degradation of Pentolite with zero-valent iron ($Fe^0$) in acetic acid; common reducing agents, including $LiAlH_4$ and $NaBH_4$ with or without a catalyst selected from the group of nickel (II) chloride ($NiCl_2$) and stannous chloride ($SnCl_2$); removal of the nitro group with sodium or ammonium hydrosulphide (NaSH or $(NH_4)SH$) in an alkaline solution; Raney nickel catalyst with hydrogen gas; molybdenum trioxide catalyst; palladium catalyst; and platinum catalyst. These are all examples of chemicals proven in literature to degrade PETN and/or nitrate esters. With the exception of stannous chloride none of these samples were tested for this application because they are not practical for the application method. Most of these chemicals require special conditions to render PETN or nitrate esters inert.

Example 6

The degradation of PETN and Pentolite was also tested with remediation solutions with similar concentrations of all components but methylpyrrolidone (NMP) was used instead of DMF. Those results are listed in the table below. All three samples were declared to be insensitive to the impact test.

| Sample | $SnCl_2$ | NaOH | $H_2O$ | NMP | PETN |
|---|---|---|---|---|---|
| 1 | 1.75 | 1.83 | 83.31 | 12.5 | 0.61 |
| 2 | 1.0 | 6.7 | 20.5 | 71.3 | 0.4 |
| 3 | 0.4 | 1.0 | 19.0 | 78.6 | 1.0 |

Example 7

Samples were prepared to evaluate the mechanical breakup of a Pentolite booster by addition of a water absorbing gum, such as guar and xanthan gums. Both gums have shown to physically break the Pentolite into small fragments in less than 24 hours when added at a 0.2, 0.3, 0.5 and 1.0% w/w level and submerging the Pentolite booster in water. Pentolite with as low as 0.2% w/w gum additive will physically break apart into small crumbly fragments after being submerged in water for 30 days. The fragmented booster has been shown to be insensitive to initiation using a standard #8 detonator.

Briefly, a quantity of TNT were added and heated at 95° C. until melting in a reactor provided with a heating jacket and with mechanical stifling. Then, a quantity of PETN were added with a quantity of a gum [e.g., xanthan gum or guar gum] and a quantity of a wax. The components were stirred until achieving a homogeneous mixture which was poured on a cylindrical mold and left to cool, in order to obtain a composition of PETN/TNT/gum/wax with the desired percentage. The cylinders thus obtained are submersed in water at room temperature (18-22° C.) and the effect obtained on the integrity of the cylinder is determined at different times. More information can be found on Example 14].

Example 8

A suitable chemical may be added to LDPE, MDPE, HDPE, polyester or polypropylene to form a plastic that will biodegrade or weaken when exposed to bacteria found in soil and ground water. This biodegradable plastic may be used to contain the remediation solution or contain the pentolite/gum mixture. This biodegradable plastic will degrade to the point of releasing the remediation solution after sometime (1-5 years for thin films) of being exposed to environmental elements. The degradation of a plastic barrier which is considerably thicker will also allow water to surround the pentolite/gum mixture to cause the physical disintegration of the pentolite booster in 5-20 years.

Example 9

Biodegradable plastics made by a variety of companies may also be used as the barrier between the pentolite and the remediation solution. Biodegradable plastic sold under the name of Cleanwaste WAG bag was tested for compatibility with the remediation solution and ability to break down. The Cleanwaste WAG bags are used to dispose of human waste. Solid hydroxide (e.g., NaOH or KOH) was sealed in the bag and placed in water to test for permeability. Approximately 50% of the solid hydroxide was dissolved in 1 week. The remediation solution was also sealed in a biodegradable bag that was in imminent contact with pentolite. After approximately 6 months the pentolite started to degrade but the bag was mostly intact.

Example 10

Various packaging materials were tested for breakthrough time (dry solid or chemo-remediation chemical solution to break the material barrier), degradation time and compatibility with sodium hydroxide (NaOH) and potassium hydroxide (KOH).

Several types of plastics have been proven to be compatible with the remediation solution but will not break down to release the solution without a mechanical device to puncture the barrier. Tested plastics include polypropylene, polyester, HDPE, MDPE and LDPE, and Barex.

Polypropylene, polyester, HDPE, MDPE and LDPE showed no signs of breaking down after six months when exposed to the chemo-remediation chemicals in dry solid or concentrated solution forms.

Example 11

There are also other types of material that are compatible with hydroxide in the solid form (e.g., NaOH, KOH, etc.) but will break down when water is added to the hydroxide. Aluminum will not react with solid hydroxide as long as no water is allowed to come in contact with the hydroxide and aluminum. An aluminum coated polyester (Mylar) was tested with solid hydroxide and hydroxide solution. There was no reaction observed for more than 6 months with solid hydroxide. The aluminum coating rapidly (less than 1 day) degraded when water was added to the hydroxide, but the solution was contained for at least 6 months by the Mylar barrier.

Effectively, an aluminium coating on polyester film (Mylar) showed rapid degradation (less than one day) of the aluminium layer, but the plastic remained in good condition for at least six months. Aluminium foil reacted very fast with KOH or NaOH solution, but lasted indefinitely (more than 6 months) when exposed to the dry material. As predicted an aluminum barrier could be used as a long-term or short-term barrier depending on the condition of the alkaline material.

Example 12

Polypropylene, HDPE and Teflon provide excellent water barriers (tested). Other plastics such as PVC and PET will also provide a good moisture barrier (not tested). These plastics may be formed into small hollow beads with water expandable material and/or remediation solution incorporated into the centers of the beads.

Example 13

The presence of PETN, TNT, RDX and HMX after chemical remediation was tested by two well known methods: HPLC and Fallhammer. The HPLC measured the concentration of a known explosive. This test was only performed on samples that showed no reaction when a 10 kg weight was dropped from 60 cm. All samples were tested for the impact sensitivity by a Fallhammer apparatus. The samples were first tested with 1 kg weight falling from a height of 30-40 cm. This is the height and weight reported in literature for reliable initiation of PETN. If RDX and HMX were being tested then 5 kg weight was dropped from 20-40 cm. If there was no reaction the height and weight was increased until a reaction occurred. The maximum height and weight was 60 cm and 10 kg, respectively.

Example 14

Physical-Mechanical Breakdown or Rupture of Pentolite by Means of Using Water-Swellable Polymers This test was carried out to evaluate the physical-mechanical breakdown or rupture of compositions of pentolite (60/40 PETN/TNT) with different natural polymers, specifically, xanthan gum (Rhone Poulenc Rhodopol XB-23), gum karaya (Carob, S.A. powder-10), gum tragacanth (Carob, S.A. powder) and guar gum (Carob, S.A. 5000 cps).

Briefly, cylinders were prepared containing 165 g of pentolite/cylinder and the polymers indicated in Table 1, in the proportions and amounts indicated in said table. To that end, the amount of TNT according to Table 1 was added and heated at 95° C. until melting in a reactor provided with a heating jacket and with mechanical stirring; then, the amount of PETN (according to Table 1) was added with the corresponding amount of polymer (Table 1) and 1.65 g of paraffin wax (Iberceras). The components were stirred until achieving a homogeneous mixture which was poured on a cylindrical mold and left to cool, a percentage composition as indicated in Table 1 being obtained. The cylinders were submersed in water at room temperature (18-22° C.) and the effect obtained on the integrity of the cylinder was determined at different times. The obtained results, expressed according to the observed effect [none, 0; cracking of the cylinder, 1; and complete rupture of the cylinder, 2], the percentage of polymer and the time during which the cylinder was submersed in water at room temperature, are shown in Table 2.

TABLE 1

Composition of the pentolite formulations with different swellable polymers

| PENTOLITE | Xanthan % | Guar % | Tragacanth % | Karaya % | PETN % | TNT % | Wax % | PETN g | TNT g | Wax g | Polymer g | Total g |
|---|---|---|---|---|---|---|---|---|---|---|---|---|
| Reference | | | | | 59.50 | 39.50 | 1 | 98.18 | 65.18 | 1.65 | 0.00 | 165 |
| +1% Xanthan gum | 1 | | | | 59.00 | 39.00 | 1 | 97.35 | 64.35 | 1.65 | 1.65 | 165 |
| +0.5% Xanthan gum | 0.5 | | | | 59.25 | 39.25 | 1 | 97.76 | 64.76 | 1.65 | 0.83 | 165 |
| +0.3% Xanthan gum | 0.3 | | | | 59.35 | 39.35 | 1 | 97.93 | 64.93 | 1.65 | 0.50 | 165 |
| +0.2% Xanthan gum | 0.2 | | | | 59.40 | 39.40 | 1 | 98.01 | 65.01 | 1.65 | 0.33 | 165 |
| +1% Gum karaya | | | | 1 | 59.00 | 39.00 | 1 | 97.35 | 64.35 | 1.65 | 1.65 | 165 |
| +0.5% Gum karaya | | | | 0.5 | 59.25 | 39.25 | 1 | 97.76 | 64.76 | 1.65 | 0.83 | 165 |
| +1% Gum tragacanth | | | 1 | | 59.00 | 39.00 | 1 | 97.35 | 64.35 | 1.65 | 1.65 | 165 |
| +1% Guar gum | | 1 | | | 59.00 | 39.00 | 1 | 97.35 | 64.35 | 1.65 | 1.65 | 165 |

TABLE 2

Physical-mechanical breakdown or rupture of pentolite due to the action of several water-swellable polymers

| Polymer content (%) | Time | | | | | | | | | |
|---|---|---|---|---|---|---|---|---|---|---|
| | 40 min | 1 h | 2 h | 3 h | 4 h | 21 h | 29 h | 55 h | 3 months | 5 months |
| Xanthan gum (Rhodopol XB-23) | | | | | | | | | | |
| 1 | 2 | | | | | | | | | |
| 0.5 | | 2 | | | | | | | | |
| 0.3 | | 2 | | | | | | | | |
| 0.2 | | | 1 | 2 | | | | | | |
| Gum karaya | | | | | | | | | | |
| 1 | | 1 | | | 2 | | | | | |
| 0.5 | | | | | | 1 | 2 | | | |
| Gum tragacanth | | | | | | | | | | |
| 1 | | | | | | | | 1 | | |
| Guar gum | | | | | | | | | | |
| 1 | | | | | | 1 | | | | |

Mechanical effect

| | |
|---|---|
| None | 0 |
| Cracking | 1 |
| Complete rupture | 2 |

As can be seen, in the tested conditions, the breakdown rate (physical-mechanical rupture) of the cylinders of pentolite with the different tested polymers can be summarized in the following decreasing order:

Xanthan gum>gum karaya>guar gum>gum tragacanth

Example 15

Physical-Mechanical Rupture of Pentolite by Means of Using Xanthan Gum (0.5-1%)

64.35 g of TNT were added and heated at 95° C. until melting in a reactor provided with a heating jacket and with mechanical stirring. Then, 97.35 g of PETN were added with 1.65 g of xanthan gum (Rhone Poulenc Rhodopol XB-23) and 1.65 g of paraffin wax (Iberceras). The components were stirred until achieving a homogeneous mixture which was poured on a cylindrical mold and left to cool, a percentage composition of PETN/TNT/xanthan gum/wax: 59/39/1/1, being obtained. The cylinders thus obtained were submersed in water at room temperature (18-22° C.) and the effect obtained on the integrity of the cylinder was determined at different times. The obtained results were the following: a fast breakdown of the cylinder with a complete rupture in 40 minutes after its immersion in water was observed, giving rise to a composition insensitive to the detonator.

Following the previously described process but adding 0.825 g of xanthan gum a mixture was obtained with a percentage composition of PETN/TNT/xanthan gum/wax: 59.25/39.25/0.5/1. The results obtained upon submersing the cylinders thus obtained in water at room temperature (18-22° C.) were the following: the cylinder of pentolite was physically decomposed in 1 hour after its immersion in water, giving rise to a composition insensitive to the detonator.

Example 16

Physical-Mechanical Rupture of Pentolite by Means of Using Gum Karaya (0.5-1%)

The test described in Example 15 was repeated but using gum karaya instead of xanthan gum, a percentage composition of PETN/TNT/gum karaya/wax: 59/39/1/1, being obtained. The results obtained upon submersing the cylinders thus obtained in water at room temperature (18-22° C.) were the following: after 1 hour of immersion under water at room temperature the occurrence of cracks in the cylinder of pentolite is detected, and at the end of 4 hours the complete rupture thereof takes place, giving rise to a composition insensitive to the detonator.

Following the previously described process but adding 0.825 g of gum karaya a mixture was obtained with a percentage composition of PETN/TNT/gum karaya/wax: 59.25/39.25/0.5/1. The results obtained upon submersing the cylinders thus obtained in water at room temperature (18-22° C.) were the following: complete breakdown of the cylinder of pentolite was obtained after 29 hours submersed in water, giving rise to a composition insensitive to the detonator.

Example 17

Physical-Mechanical Rupture of Pentolite by Means of Using Gum Tragacanth (1%)

The test described in Example 15 was repeated but using gum tragacanth instead of xanthan gum, a percentage composition of PETN/TNT/gum tragacanth/wax: 59/39/1/1, being obtained. The results obtained upon submersing the cylinders thus obtained in water at room temperature (18-22° C.) were the following: the cylinder of pentolite cracks after 55 hours.

Example 18

Physical-Mechanical Rupture of Pentolite by Means of Using Guar Gum (1%)

The test described in Example 15 was repeated but using guar gum instead of xanthan gum, a percentage composition of PETN/TNT/guar gum/wax: 59/39/1/1, being obtained. The results obtained upon submersing the cylinders thus obtained in water at room temperature (18-22° C.) were the following: the cylinder of pentolite cracks after 21 hours.

Example 19

Degradation of TNT with $Fe^0$ 30 ml were taken from an initial solution of 80 mg of TNT in 1 liter of water, to which 10 g of iron powder (Podmet lot2799) were added and the mixture was maintained under stirring at room temperature (TNT Fe in water, r3, test). After stifling for 24 hours at room temperature, TNT was not detected when it was analyzed by high performance liquid chromatography (HPLC). When the previously described test was carried out with 5 g of iron (TNT Fe in water, r6, test) 100 hours were necessary in order for the TNT to disappear.

HPLC Method: SPHERISORB ODS 2 250×4 mm 5μ column, phase: 62/38 acetonitrile-water (v/v) 40° C., 1 ml/min flow, 106 bar pressure, 5 μl injection volume.

Figure 12:
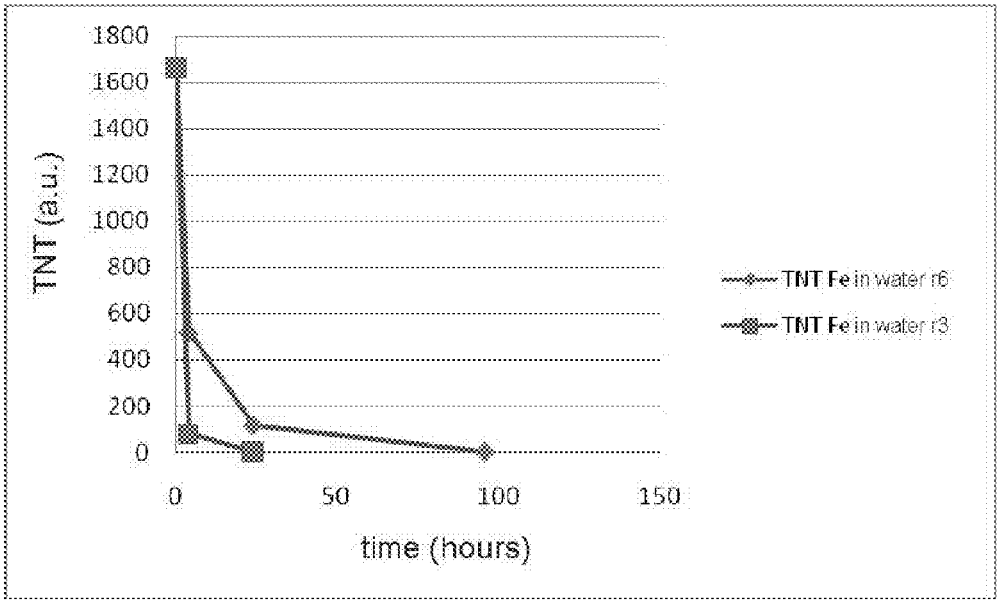
FIG. 12 is a graph showing the degradation rate of TNT in aqueous solution with iron) ($Fe^0$) powder in different amounts.

FIG. 12 shows the degradation rate of TNT with iron powder ($Fe^0$). Table 3 includes information on the evolution of TNT degradation by means of reducing with iron powder over time in both tests.

TABLE 3

Reduction of TNT with $Fe^0$

| | Additive | Time (h) | Water/additive ratio | TNT a.u. |
|---|---|---|---|---|
| TNT in water | | 0 | | 1667.57 |
| TNT in water | Fe powder | 4 | 3 | 79.03 |
| TNT in water | Fe powder | 24 | 3 | 0.00 |
| TNT in water | | 0 | | 1667.57 |
| TNT in water | Fe powder | 4 | 6 | 517.26 |
| TNT in water | Fe powder | 24 | 6 | 113.80 |
| TNT in water | Fe powder | 96 | 6 | 0.00 |

a.u.: area units of the chromatographic detector

Example 20

Degradation of TNT with Different Additives

The process described in Example 19 was repeated, but replacing iron powder ($Fe^0$) with:

a) zinc/ammonium chloride ($Zn/ClNH_4$) at a 2.5:1 weight ratio, at different water/additive (3 and 6) weight ratios; or with
b) zinc/salicylic acid t a 2.5:1 weight ratio, t different water/additive weight ratios (3 and 6); or with
c) ferrous sulfate ($SO_4Fe$) at a water/additive weight ratio of 3.

The obtained results are shown in Table 4, which includes information on the evolution of the degradation of TNT dissolved in water by means of using several reducing agents (additives) according to the content and reaction time.

TABLE 4

Chemical decomposition rate of TNT by different reducing agents

| | Additive | Time (h) | Water/additive ratio | TNT a.u. |
|---|---|---|---|---|
| TNT in water | | 0 | | 1667.57 |
| TNT in water | $Zn/ClNH_4$ (2.5:1) | 4 | 3 | 0.00 |
| TNT in water | $Zn/ClNH_4$ (2.5:1) | 4 | 6 | 0.00 |
| TNT in water | Zn/Salicylic ac. (2.5:1) | 4 | 3 | 0.00 |
| TNT in water | Zn/Salicylic ac. (2.5:1) | 4 | 6 | 0.00 |
| TNT in water | $SO_4Fe$ | 4 | 3 | 0.00 |

a.u.: area units of the chromatographic detector

As can be seen, at the end of 4 hours all the TNT dissolved in water had been chemically decomposed (degraded) by any of the additives added, independently of the water/additive ratio used.

In view of Examples 19 and 20 (Tables 3 and 4), it is observed that the chemical decomposition rate of the TNT in aqueous solution is greater using Zn/salicylic acid (2.5:1), $Zn/NH_4Cl$ (2.5:1) or ferrous sulfate (4 hours for complete decomposition of the TNT dissolved in water) as a reducer than using $Fe^0$ (24-96 hours for complete decomposition of the TNT dissolved in water depending on the water/$Fe^0$ weight ratio).

Example 21

Degradation of PETN with $Fe^0$

Different solutions were prepared with an initial solution of 6 mg of PETN in 1 liter of water, changing:

- in some cases, the pH of the solution by means of adding an aqueous solution of NaOH (10%) until generating a solution with pH 8 and another with pH 10; and
- in other cases, the iron powder ($Fe^0$) content to generate a solution with an $H_2O/Fe^0$ weight ratio=3 and another solution with an $H_2O/Fe^0$ weight ratio=6.

The different solutions were maintained under mechanical stifling, samples being collected at different times up to a total of 22 days (258 hours) to analyze the PETN by means of HPLC.

HPLC Method: SPHERISORB ODS 2 250×4 mm 5μ column, phase: 62/38 acetonitrile-water (v/v) 40° C., 1 ml/min flow, 106 bar pressure, 50 μl injection volume.

Figure 13:
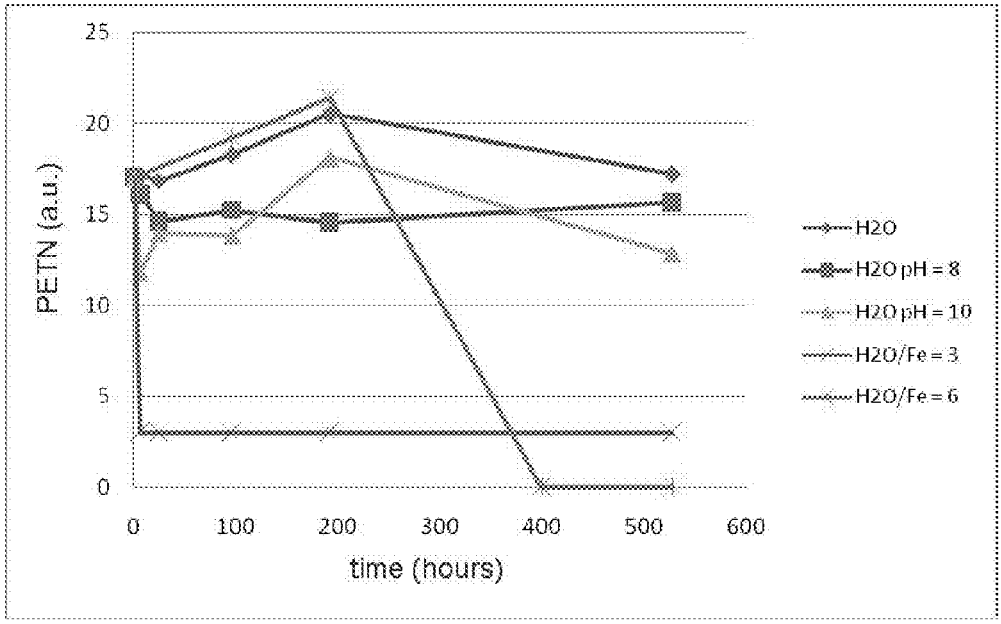
FIG. 13 is a graph showing the degradation rate of PETN in aqueous solution with iron) ($Fe^0$) powder in different amounts and at different pH values.

The degradation rate of the PETN with iron powder ($Fe^0$) in water can be observed in FIG. 13. As can be seen, when the $H_2O/Fe^0$ weight ratio is 3, the decomposition rate is greater than when the $H_2O/Fe^0$ weight ratio is 6. Likewise, it can be seen in said FIG. 13 that PETN in water at different pHs does not undergo degradation.

Example 22

Degradation of PETN by $Zn/ClNH_4$ (2.5:1)

The process described in Example 21 was repeated, but replacing the iron powder ($Fe^0$) with zinc/ammonium chloride ($Zn/ClNH_4$) in a 2.5:1 weight ratio, in different water/additive weight ratios (3 and 6).

The obtained results are shown in Table 5, which shows information on the evolution of the degradation of the PETN dissolved in water by means of using $Zn/ClNH_4$ (2.5:1) according to the content and reaction time.

TABLE 5

Chemical decomposition rate of PETN by $Zn/ClNH_4$ (2.5:1)

| | Additive | time (h) | Water/additive ratio | PETN a.u. |
|---|---|---|---|---|
| PETN | | 0 | | 17 |
| PETN in water | $Zn/ClNH_4$ (2.5:1) | 4 | 3 | 0.00 |
| PETN in water | $Zn/ClNH_4$ (2.5:1) | 4 | 6 | 0.00 |

As can be seen, at the end of 4 hours all the PETN dissolved in water had been chemically decomposed (degraded) by $Zn/ClNH_4$ (2.5:1), independently of the water/additive ratio used.

In view of Examples 21 and 22 (FIG. 13 and Table 5), it is observed that the chemical decomposition rate of PETN in aqueous solution is greater using $Zn/NH_4Cl$ (2.5:1) (4 hours for complete decomposition of the PETN dissolved in water) as a reducer than using $Fe^0$ (6 hours for complete decomposition of the TNT dissolved in water, at an $H_2O/Fe^0$ weight ratio=3).

Example 23

Physical-Mechanical Rupture of Pentolite by Means of Using Xanthan Gum (0.5-1%) and Subsequent Treatment with Zinc/Ammonium Chloride 60.23 g of TNT were added and heated at 95° C. until melting in a reactor provided with a heating jacket and with mechanical stifling. Then 93.22 g of PETN were added with 1.65 g of xanthan gum (Rhone Poulenc Rhodopol XB-23), 5.9 g of zinc, 2.36 g of ammonium chloride and 1.65 g of paraffin wax (Iberceras). The components were stirred until achieving a homogeneous mixture which was poured on a cylindrical mold and left to cool, a percentage composition of PETN/TNT/Zn—$NH_4Cl$/xanthan gum/wax: 56.5/36.5/5/1/1, being obtained. The cylinders thus obtained were submersed in water at room temperature (18-22° C.) and the effect obtained on the integrity of the cylinder at different times was determined. The obtained results were the following: the cylinder of pentolite cracks after 20 minutes submersed under water and is completely broken down at the end of 40 minutes, giving rise to a composition insensitive to the detonator.

The invention claimed is:

1. A method for manufacturing an explosive device capable of self-remediation, if the explosive device fails to detonate as intended, the method comprising the steps:

- forming a quantity of an explosive material into an explosive device;
- identifying a water expandable material, said water expandable material being capable of mechanically destroying the explosive material; and
- incorporating a quantity of the water expandable material into the explosive material in the explosive device so that, when the explosive device is exposed to water coming from the actual moisture of the soil or of the subsoil as well as the inclemency of the weather, the water expandable material in the quantity thereof is capable of rendering the explosive material insensitive to initiation by any means by virtue of the fact that the explosive material has been fractured into small particles and is thus below the critical diameter sensitivity threshold for the explosive material, whereby if the explosive device is installed at a detonation site and fails to detonate as intended, when the quantity of water expandable material is activated, the water expandable material in the quantity thereof deactivates the explosive device by fracturing the quantity of explosive material in situ at the detonation site.

2. The method of claim 1, wherein the water expandable material capable of mechanically destroying the explosive material is selected from the group consisting of natural or synthetic gums and polymers having the ability to absorb one or more times their own weight in water, and mixtures thereof.

3. The method of claim 1, wherein the water expandable material is selected from the group consisting of a polysaccharide or a derivative thereof, a homopolymer or a copolymer consisting of polymethacrylates, polyacrylates, poly (acrylic acid), polyacrylamide, polyvinylpyrrolidone, polyvinyl alcohol, polylactic acid, polyalkylene oxides, starch, albumin, alginate (sodium alginate), agar, amylose, cellulose, chicle gum, gelatin, gellan gum, glucomannan, Arabic gum, guar gum, gum Arabic, karaya gum, locust bean gum, mastic gum, spruce gum, tara gum, tragacanth gum, xanthan gum, cellulose acetate, cellulose triacetate, cellulose acetate ethyl carbamate, cellulose acetate phthalate, cellulose acetate methyl carbamate, cellulose acetate succinate, cellulose acetate dimethyl aminoacetate, cellulose acetate ethyl carbonate, cellulose acetate chloroacetate, cellulose acetate ethyl oxalate, cellulose acetate methyl sulfonate, cellulose acetate butyl sulfonate, cellulose acetate propionate, cellulose acetate diethyl aminoacetate, cellulose acetate octate, cellulose acetate laurate, cellulose acetate p-toluol sulfonate, cellulose acetate butyrate, sodium acrylate, potassium acrylate, alkyl acrylate and chemical equivalents thereof, and mixtures thereof.

4. The method of claim 1, wherein the water expandable material comprises a plurality of water expandable materials.

5. The method of claim 1, wherein the explosive device is encapsulated in a biodegradable material.

6. The method of claim 1, wherein the explosive material is selected from a group of explosive materials consisting of trinitrotoluene, hexanitrostilbene, hexanitroazobenzene, diaminotrinitrobenzene, triaminotrinitrobenzene, cyclotrimethylene trinitramine, cyclotetramethylene tetranitramine, nitroguanidine, 2,4,6-trinitrophenylmethylnitramine, hexanitro-hexaazaisowurtzitane, pentaerythritol tetranitrate, nitroglycerine, nitrocellulose, ethylene glycol dinitrate, halocarbons, hydrocarbons and mixtures thereof.

7. The method of claim 1, wherein the water expandable material is xanthan gum.

8. The method of claim 1, wherein the explosive material is Pentolite (TNT/PETN).

9. The method of claim 1, wherein the water expandable material is xanthan gum and the explosive material is Pentolite (TNT/PETN).

10. The method of claim 1, wherein the explosive material is Hexylite (TNT/RDX).

11. The method of claim 1, wherein the explosive material is Octolite (TNT/HMX).

12. The method of claim 1, wherein the explosive material is a mixture consisting essentially of trinitrotoluene and cyclotrimethylene trinitramine.

13. The method of claim 1, wherein the explosive material is a mixture consisting essentially of trinitrotoluene and cyclotetramethylene tetranitramine.

* * * * *